US008291894B2

(12) United States Patent
Barwick, Jr.

(10) Patent No.: US 8,291,894 B2
(45) Date of Patent: Oct. 23, 2012

(54) LOADING PELLETS IN PELLET GUNS

(76) Inventor: Billie John Barwick, Jr., Mexico Beach, FL (US)

( * ) Notice: Subject to any disclaimer, the term of this patent is extended or adjusted under 35 U.S.C. 154(b) by 472 days.

(21) Appl. No.: 12/428,600

(22) Filed: Apr. 23, 2009

(65) Prior Publication Data

US 2009/0301456 A1 Dec. 10, 2009

Related U.S. Application Data

(60) Provisional application No. 61/125,324, filed on Apr. 24, 2008.

(51) Int. Cl.
*F41A 9/06* (2006.01)

(52) U.S. Cl. ..... 124/45

(58) Field of Classification Search ..... 124/45, 124/50, 53

See application file for complete search history.

(56) References Cited

U.S. PATENT DOCUMENTS

| | | | |
|---|---|---|---|
| 211,691 | A | 1/1879 | Bennett |
| 391,811 | A | 10/1888 | Mixter |
| 869,484 | A | 10/1907 | Drake |
| 871,355 | A | 11/1907 | Morlan |
| 1,816,091 | A | 7/1931 | Schmeisser |
| 2,502,909 | A | 4/1950 | Wick et al. |
| 2,609,811 | A | 9/1952 | Lawrence |
| 3,463,136 | A | 8/1969 | Vadas et al. |
| 3,619,929 | A | 11/1971 | Fremont |
| 3,741,189 | A | 6/1973 | Kester et al. |
| 3,913,553 | A | 10/1975 | Braughler et al. |
| 3,984,000 | A | 10/1976 | Miller |
| 4,004,566 | A | 1/1977 | Fischer |
| 4,164,929 | A | 8/1979 | Liepins et al. |
| 4,173,211 | A | 11/1979 | Crawford, Jr. |
| 4,507,889 | A | 4/1985 | Allen |
| 4,819,609 | A | 4/1989 | Tippmann |
| 4,831,998 | A | 5/1989 | Maguire, III |
| 4,986,251 | A | 1/1991 | Lilley |
| 4,993,400 | A | 2/1991 | Fitzwater |
| 5,014,877 | A | 5/1991 | Roos |
| 5,054,221 | A | 10/1991 | Ozols |
| 5,165,383 | A | 11/1992 | Ebert et al. |
| 5,285,766 | A | 2/1994 | Milliman |
| 5,335,579 | A | 8/1994 | David |
| 5,361,746 | A | 11/1994 | Szente |
| 5,520,171 | A | 5/1996 | David |
| 5,544,642 | A | 8/1996 | Guthrie |

(Continued)

FOREIGN PATENT DOCUMENTS

| | | | |
|---|---|---|---|
| GB | 2162928 | A | 2/1986 |

(Continued)

OTHER PUBLICATIONS

Beeman Pell Seat. Details can be found at internet address http://www.pyramydair.com/s/a/Beeman_Pell_Seat/711.

*Primary Examiner* — Gene Kim
*Assistant Examiner* — Amir Klayman
(74) *Attorney, Agent, or Firm* — John B. Woodard

(57) ABSTRACT

Loading pellets into a pellet gun, whether it is of breech or break barrel design, is often a frustrating and difficult procedure, especially when done with the fingers. The pellets are small and hard to handle. Various embodiments of a dispenser for dispensing pellets to a breech design or a break barrel design pellet gun without touching them are described. The frustration and other difficulties usually encountered by pellet gun users are avoided by the dispensers delivering the pellets directly to pellet guns.

20 Claims, 14 Drawing Sheets

U.S. PATENT DOCUMENTS

| | | | |
|---|---|---|---|
| 5,666,937 | A | 9/1997 | Mendoza-Orozco |
| 6,098,835 | A | 8/2000 | DeJonge |
| 6,530,368 | B1 | 3/2003 | Maeda et al. |
| 6,666,203 | B2 | 12/2003 | Maeda et al. |
| 6,688,298 | B2 | 2/2004 | Maeda et al. |
| 6,736,125 | B2 | 5/2004 | Petrosyan et al. |
| 6,824,011 | B1 | 11/2004 | Woempner |
| 7,017,569 | B2 | 3/2006 | Jong |
| 7,954,480 | B2 | 6/2011 | Broberg, Jr. |
| 2005/0210608 | A1 | 9/2005 | Walters et al. |
| 2008/0029076 | A1 | 2/2008 | Liang |

FOREIGN PATENT DOCUMENTS

| | | | |
|---|---|---|---|
| GB | 2281959 | A | 3/1995 |
| GB | 2395770 | A | 6/2004 |

LOADING PELLETS IN PELLET GUNS

CROSS REFERENCE TO RELATED APPLICATION

This application claims the benefit of co-pending U.S. Provisional Patent Application No. 61/125,324, filed Apr. 24, 2008.

BACKGROUND OF THE INVENTION

Dating from the fifteenth century, air guns have been used for war, hunting, and sport. Early guns provided advantages over the match lock powder rifles of the time with improvements in terms of repeatability, quietness, stealth, speed and reliability of fire. However, the limitations on mechanical technology in the fifteenth century made construction of large quantities of reliable air operated guns impractical.

By the mid to late eighteenth century mechanical technology had improved, and air guns were developed for use by European armies. In America in the early part of the nineteenth century Lewis and Clark carried an air rifle with them on their famous exploration of the West.

The operational success of these air guns was largely due to the size of shot used with them. Although the guns provided fairly low muzzle velocities by twenty-first century standards, at most a few hundred feet per second, the shot often used was a lead ball of from about 30 caliber (7.62 mm) to about 60 caliber (15.24 mm) with a weight of a few grams to well over ten grams. As a consequence, some of these air guns had the striking power at 100 yards of a modern day 45 caliber ACP cartridge. Because they often carried a magazine of twenty or more balls and could fire rapidly from their magazines, the air gun gave advantages that were not otherwise available in the nineteenth century. Again, however, mechanical challenges in construction and maintenance limited the use of air guns.

In the eighteenth and early nineteenth century nearly all guns whether powder driven or air driven used spherical balls for ammunition making, in the case of air guns, various mechanisms for loading from a magazine fairly simple to design.

In the modern world the air gun has developed into an ever more effective weapon now usually referred to as a pellet gun which is sometimes operated using gases other than air. Many modern pellet guns are purposely designed to be of relatively low power for reasons of safety and to satisfy legal requirements that have developed around them. However, high power versions of these guns are available, and these can provide muzzle velocities that substantially exceed the speed of sound.

In addition the ammunition for these guns has developed from the lead balls of the past into shapes that are particularly effective when shot through a rifled barrel giving stability to pellet flight. The most popular pellet size is 0.177 inch (4.5 mm) in diameter with a construction that provides a variously shaped head, often, but not always, pointed with a skirt protruding behind a necked down waist. The inside of the skirt is hollow and is designed to expand engaging the rifling of the pellet gun to spin the pellet when the gun is fired. This gives the pellet stability during its flight to the target improving accuracy over round shot.

Calibers other than the 0.177 inch caliber are available with the 0.20 inch (5.0 mm), 0.22 inch (5.5-5.6 mm), and 0.25 inch (6.35 mm) calibers being the most commonly available.

Unfortunately, all of these pellets are quite small to handle with precision. To operate properly the pellets must be oriented in the firing chamber of the pellet gun with the skirt at the back of the chamber so that the expanding gas that fires them can expand the skirt to engage the barrel rifling. The problem has been solved in some pellet gun designs by providing a removable magazine, usually a small plastic ring, loaded with properly oriented pellets that can be forced into the firing chamber by the gun itself.

However, many, if not most, guns are single shot designs. These usually come in two varieties, breech loading and break barrel.

In the breech loading design pellets must be placed on a loading rail in a breech that is about 1 cm long and is usually difficult to reach. This is especially so when a telescopic sight is placed over the breech of the gun. A bolt that is similar to, but smaller than, a bolt action rifle bolt is then used to push the pellet into the chamber of the pellet gun. Each pellet must be loaded by hand, and the small size of the pellets combined with the critical orientation of placement in the chamber of the gun make loading them difficult and often frustrating, the pellets having a proclivity to get reversed or misaligned on the loading rail.

In the break barrel design the barrel and firing chamber of the pellet gun fold away from the rest of the pellet gun, similar to the action found in most double barrel shot guns, and a pellet is pressed into the chamber using a finger to push it home. In this case it is critical to keep the small pellet in proper orientation which is difficult to do because of the pellet's small size compared to the size of the human hand that is loading it into the gun.

A better method of loading pellets into these single shot designs is needed.

BRIEF DESCRIPTION OF THE INVENTION

A dispenser for loading pellets, each having a head and a skirt, into a pellet gun without a user having to touch the pellets is provided.

The dispenser is comprised of an open ended tube having a proximal end and a distal end for holding the pellets in line and in longitudinal orientation within the tube with the head of each longitudinally oriented pellet toward the distal end of the tube and the skirt of each longitudinally oriented pellet toward the proximal end of the tube.

A retention device is located at the open distal end of the tube for holding an end pellet in the tube, and a plunger is located proximally at the end of the pellet line in communication with the last pellet for pushing the longitudinally oriented pellets toward the distal end of the tube to eject the end pellet at the distal end of the tube from the tube into the pellet gun.

A slot is provided in the side of the tube for the plunger to follow as it is advanced toward the distal end if the tube as the plunger ejects each pellet.

A dispenser is provided for loading pellets, each with a head, a waist, and a skirt, into a pellet gun without a user having to touch the pellets. The dispenser comprises a tube having a proximal end and a distal end. Pellets in side-by-side orientation are placed inside the tube for dispensing through the side of the tube, and a loading hole is disposed adjacent the proximal end of the tube for inserting the pellets in side-by-side orientation.

A retractable spring is positioned in the proximal end of the tube for pushing the pellets toward the distal end of the tube, and an exit hole perpendicular to the axis of the tube through opposite sides of the tube is placed adjacent the distal end of the tube for dispensing pellets from the tube.

A plunger is positioned on the tube for singly pushing pellets out of the exit hole, and a retention device adjacent the exit hole engages each pellet as it is passed through the side of the tube and holds the pellet in the tube until it is dispensed by the plunger.

A guide strip that extends from adjacent the loading hole to adjacent the retention device holds the pellets in orientation as they pass through the length of the tube and engages the waist of each pellet to maintain the pellet in desired orientation A cap is provided for covering the loading hole to prevent loaded pellets from falling out of the tube.

A dispenser is also provided for dispensing individual pellet gun pellets into a firing chamber of a break barrel design pellet gun without a user's hand having to touch the pellets. The dispenser comprises a storage device for storing the pellets individually in an orientation desired by a user and is shaped to allow each pellet to be placed adjacent the firing chamber of the pellet gun prior to being removed from the storage device.

A pellet removing device is provided for removing an individual pellet from the storage device and delivering the pellet in the desired orientation to the firing chamber of the pellet gun.

A pellet seating device locates each delivered pellet in substantially the same position in the firing chamber of the pellet gun.

BRIEF DESCRIPTION OF THE DRAWINGS

FIG. 10 C is a pellet dispenser.

DETAILED DESCRIPTION OF THE INVENTION

Loading pellet gun pellets into pellet guns can be a frustrating and difficult procedure. The difficulties are largely caused by the small size of the pellets, the requirement for specific orientation of the pellets for them to work properly in a modern pellet gun, loading location accessibility issues surrounding gun design, consistency in locating each successive pellet reliably in the same position in the pellet gun before firing, and stability of pellets as they are moved into firing position once loaded into the gun.

Herein firing means the act of pulling the trigger of a pellet gun to release a charge of gas that ejects a pellet from the barrel of the pellet gun.

The problems are exacerbated in that often the length of the pellets is close to the diameter of the pellets making them prone to tumbling and misalignment as they are loaded. Nonetheless, pellets must be properly oriented in the firing chamber of a pellet gun for the gun to operate properly, and they need to be inserted in the same position in the gun from shot to shot to assure precision results in targeting the round.

Figure 1:
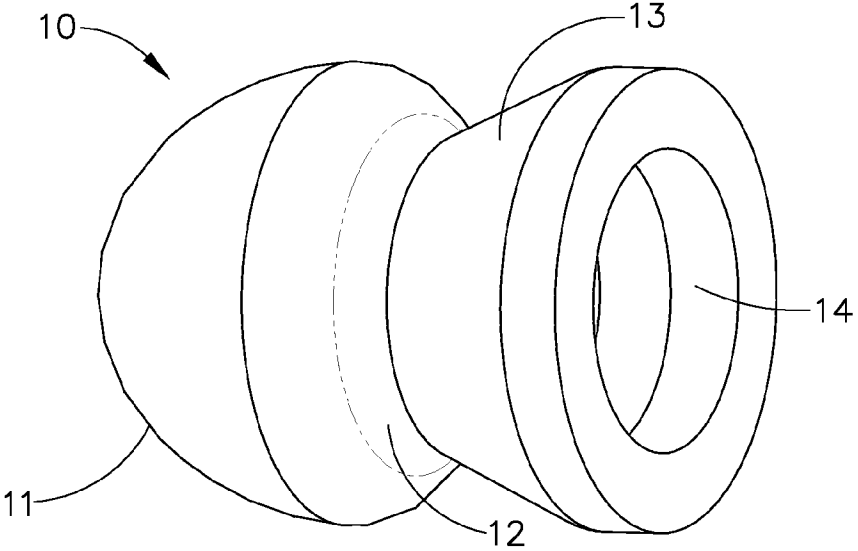
FIG. 1 is a pellet.

FIG. 1 is a typical pellet 10 of the type used in most modern pellet guns. The pellets 10 are usually made of lead, though pellets 10 made of other materials are available.

Most of these pellets 10 are similar to each other in design. Individual pellets 10 are comprised of a pellet head 11 that is made to fit tightly into the barrel of a pellet gun, a waist 12 that is formed behind the head 11 and is narrower than the head 11, and a skirt 13 that is formed behind the waist 12 of the pellet. The head 11 is often designed to penetrate or provide some specific performance when the fired pellet interacts with the target.

The skirt 13 is usually hollow 14 and is usually designed to be expanded into the rifling of the pellet gun barrel by the compressed gas charge when the gas charge of the pellet gun is released into the firing chamber.

The firing chamber is the part of the pellet gun into which compressed gas is released to shoot a pellet from the barrel of the gun.

The expansion of the skirt 13 is critical to the performance of the pellet gun. As the pellet 10 is exposed to the compressed gas firing charge of the gun, the pellet skirt 13 is expanded slightly by the gas charge and engages the rifling in the gun barrel. As the pellet 10 passes through the gun barrel the rifling in the barrel spins the pellet 10 improving its stability in flight to the target. Spinning the pellet 10 in this manner dramatically increases the accuracy of the pellet gun.

Loading pellets 10 one at a time is nearly always difficult whether one is loading through the breech of breech design or loading a break barrel design. Shooters are nearly always forced to load all single shot pellet gun designs using their fingers to place and or press the pellets 10 into the various actions of the pellet guns. This involves several problems. For example, lead pellets 10 are somewhat pliable, and it is easy to deform the skirt 13 of a pellet 10, which is designed to be deformable. If the pellet 10 is subjected to an unexpected force such as could occur when a pellet 10 is dropped on the floor or if a container of pellets 10 is shaken hard, skirt 13 deformations can and do occur.

If the skirt 13 of the pellet 10 is deformed, it can be difficult to place the pellet 10 into the firing chamber of a pellet gun due to the small size of the pellets 10 and the tight tolerances necessary to ensure that the skirt 13 is deformed into the rifling of the pellet gun when fired. Doing so with the fingers can lead to additional difficulties. For example the pellets 10 tend to stick to the fingers and are difficult to place and make stay in place; the pellets 10 tend to tumble when placed into the breech of a pellet rifle; pellets 10 sometimes fail to move smoothly when slid into the chamber using a bolt action design, also called a breech design herein, leading to misalignment, tumbling and jamming; in a break barrel design pellets 10 can be misaligned trying to place them in the chamber causing a jam that makes the action nearly impossible to close and the pellet 10 difficult to remove and replace; and a variety of other similar problems can occur.

A mechanical method of placement where the shooter's fingers need not touch the pellet, and the pellet 10 can be placed accurately near or in the chamber of a pellet gun allows the shooter to avoid frustration, dirty fingers from handling lead pellets 10, and other problems as mentioned above associated with loading pellets 10 in a pellet gun. As will be seen in the various embodiments of the invention pre-positioning pellets 10 in a dispenser also protects them from deformation due to inadvertent mishandling.

It has been found that the best placement occurs when pellets 10 are dispensed individually using a mechanical device with a pellet holder storage device that delivers the pellet accurately near or into the firing chamber of the pellet gun. This is usually best accomplished by incorporating a plunger or other mechanical device for dispensing a pellet from a holder. The holders need to be able to place a pellet accurately and in a manner in which the pellet is unlikely to move after placement due to holder movement as the holder is withdrawn from the loading area of the pellet gun. Trying to manipulate individual pellets 10 with one's fingers is thus avoided allowing precision placement of the pellets 10 without the problem of the pellets 10 being moved because they stick to the fingers, tumbling because they have to be moved too far by a pellet gun bolt, or being inadvertently removed from the firing chamber or from the breech of a pellet gun.

The breech of a pellet gun is an opening where a pellet 10 can be placed prior to being inserted in the firing chamber.

Figure 2A:
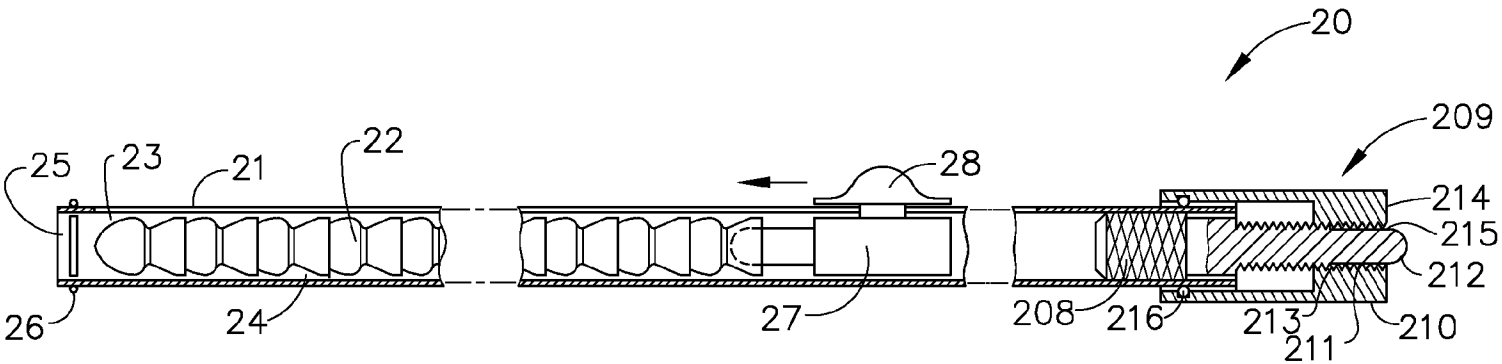
FIG. 2A is a pellet dispenser.

In one embodiment a dispenser 20 is shown in FIG. 2A which is comprised of a tube 21 having an inside diameter slightly larger than the diameter of a pellet 22 so that loaded pellets 22 can be slid along the length of the tube 21. In FIG. 2A individual pellets 22 are loaded one behind the other all oriented in the same direction, head 23 to skirt 24 as shown. On one end the tube is open 25 and a retention device 26 for keeping the pellets 22 from falling out of the tube 21 is used to retain the oriented pellets 22 in the tube 21. A plunger 27, the handle 28 of which extends outside the tube 21 and runs most of the length of the tube 21 in a slot cut through the side of the tube 21, is pushed against the skirt 24 of the last pellet 22 to advance the pellets 22 along the tube 21 to the retention device 26.

On the proximal end of the tube 21, which is the end opposite the end comprising the retention device 26, a pellet seating device 209 is provided on the dispenser 20. This seating device 209 can be built into the tube 21 with its adjustment knob 208 accessible through the sides of the tube by removing parts of the side of the tube 21, or it can be removably mounted on the tube 21. In the embodiment shown in FIG. 2A the pellet seating device 209 is removably mounted on the tube 21. The pellet seating device 209 is particularly useful for break barrel design pellet guns.

In the case of a break barrel design, a bolt is not used to insert a pellet 22 into the firing chamber of the gun. Instead, the firing chamber is exposed when the barrel is opened. This allows the insertion of the pellet 22 directly into the firing chamber and is usually accomplished by simply picking up a pellet 22 with one's fingers and inserting it into the firing chamber. Doing so suffers from all the problems mentioned above with the exception of problems relating to the bolt, since a bolt is generally not used in a break barrel design. However, an additional difficulty does occur with the break barrel design.

In the breech design when the bolt is closed, the pellet 22 is pushed into the firing chamber of the gun by the bolt, which is usually a solid non-adjustable part of a pellet gun that is intended to engage the pellet 22 in the same way every time a pellet 22 is loaded. Consequently, the pellets 22 are inserted into the firing chamber at the same depth every time so long as pellet alignment with the bolt is maintained.

However, with the break barrel design the pellet 22 is hand placed in the firing chamber of the gun and is usually pushed into the firing chamber with a push of the finger. This introduces variability in the position of the pellet in the firing chamber. Sometimes the pellet is not squarely placed in the chamber, and sometimes it is not inserted deeply enough in the chamber to prevent the pellet, or possibly the gun, being damaged when the barrel is closed. When either of these happens, the skirt 13 of the pellet 10 can be damaged resulting in possible air leakage around the pellet or uneven travel down the gun barrel thus compromising the precision of the shot when fired. Further, the pellet can be inserted at a different depth in the firing chamber leading to other unwanted variability in pellet location.

Herein various drawing element numbers are used to refer to pellets which can be and often are the same. Though the pellets referred to by the various numbers are generic, the different numbers used are intended to direct the reader's attention to the appropriate embodiment of the invention that is being discussed.

Attempts have been made to alleviate the skirt 13 damage by using a pointed object to push the pellet into the gun firing chamber and even to reform the skirt 13 of the pellet 10 once placed in the gun by using a rounded object to press the pellet skirt 13 into the sides of the breech to close any leaks caused by deformed or poorly loaded pellets 10. These attempts, however, have not solved the problems of constancy of depth of insertion and accurate alignment in the firing chamber. The invention solves these problems by accurately delivering a pellet to the firing chamber every time and by accurately aligning and inserting the pellet to the same depth in the firing chamber every time.

For use with break barrel pellet gun designs, a pellet 22 is delivered to the entrance of the firing chamber by pushing a pellet 22 out of the dispenser 20 using the plunger handle 28 disposed behind the last pellet's skirt at the proximal end of the line of pellets in the dispenser. Because the pellet 22 is easy to handle using the dispenser 20 and there is force involved as the pellet 22 is pushed out of the dispenser 20, the pellet 22 can be at least partially inserted into the firing chamber of the pellet gun. The dispenser will allow the pellet 22 to be inserted enough so that the pellet 22 will stay in place, remaining immobile while the dispenser is turned around and the pellet seating device 209, deployed on the proximal end of the dispenser, is applied to seat the pellet in the firing chamber. The dispenser 20 can then be set a side until loading is needed again.

In the embodiment shown in FIG. 2A the seating device 209 is comprised of a cylinder 210 cut off at substantially right angles on one end 214. The other end can be shaped to removably fit over the end of the dispenser tube 20, as shown. In FIG. 2A a retainer element 216 is used to removably friction fit the pellet seating device 209 to the dispenser 20. Alternatively, the pellet seating device 209 can be built into the tube 21 as a solid not adjustable seating device, or it can be made as a built-in adjustable embodiment by allowing access to an adjustment means. For example, such access could be provided by allowing access to the adjustment knob 208 through the sides of the tube 21.

A hole is provided down the length of the cylinder 210 in which an adjustable pin 212 is disposed. In one embodiment the pin and hole are threaded 213 as shown in FIG. 2A, and the pin is made longer than the cylinder. Using the threaded portions the position of the pin in the cylinder can be adjusted so that a shaped end of the pin 212 protrudes from the squarely cut off end of the cylinder 214. The shaped end of the pin 212 is shaped to fit the inside of the skirt 24 of a pellet when it is being advanced into the firing chamber of a pellet gun, and it is made slightly smaller than the skirt 24. The shaped end of pin 212 is shaped so that when the pellet is pressed into the firing chamber, it will deform the end of the pellet 22 pushing it into the sides of the firing chamber to create a substantially gas tight seal.

In use the squared off end of the cylinder 214 is pressed down on the end of the firing chamber of the break barrel design gun aligning the pellet seating device 209 squarely on the barrel surrounding the firing chamber. Since in most break barrel design guns, the end of the firing chamber is perpendicular to the barrel and barrel bore, the pellet 22 is pushed squarely into the firing chamber of the gun, and the pellet 22 can be located at a precise position in the firing chamber from shot to shot by keeping the pin extension 215 constant.

When a different pellet 22 or pellet gun is used, the pin extension 215 can be adjusted for the situation needed by adjusting the knob 208 to properly adjust the pin extension to match what is needed for the pellets 22 being used in the firing chamber of the gun being used.

It is not necessary to use a threaded bore 213 in the pellet seating device 209. A friction fit could be used to immobilize the pin once set or another immobilization arrangement could be used to keep the pin from moving once it is in the desired position.

Alternatively, the pellet seating device could be made in a not adjustable version for any particular set of pellet gun and particular pellets used with the gun. Also, if the open firing chamber is surrounded by a shaped surface, the end of the cylinder 214 could be shaped to fit the opening so that the pellets could be pushed home precisely with that particular gun arrangement.

The pellet seating device 209 can be made as an integral part of the dispenser 20, or it can be made so that it is removable as shown in FIG. 2A where it is slid over the end of the dispenser 20 using a frictional retainer 216. The advantage of making the device 209 removable is that if one has several dispensers 20, one can just move the device 209 from dispenser to dispenser as the dispensers 20 are emptied. This saves space in one's dispenser storage whether that is a shirt pocket, a box or some other storage location. Such considerations can be important in terms of convenience, cost, and flexibility of use, as well. For example, the pellet seating device could be used with several of the embodiments of the invention discussed below.

Figure 2B:
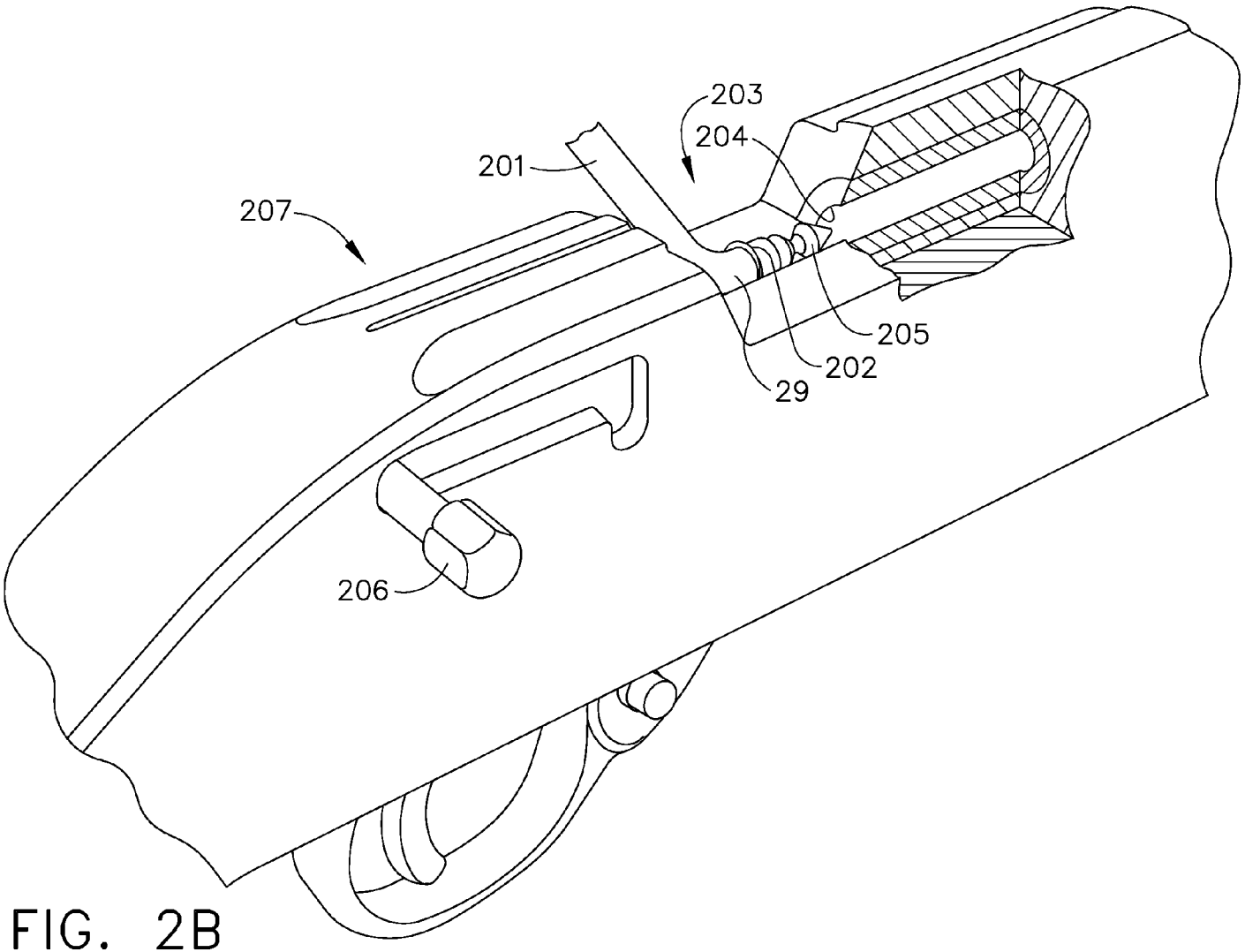
FIG. 2B is a pellet being placed in a breech design pellet gun

Another embodiment is shown in FIG. 2B. For breech loading gun designs it has been found that placing a bend 29 in the end of the dispenser tube 201 makes delivering pellets 205 into the gun breech 203 easier. In this embodiment a separate pellet seating action is not required since the bolt 206 assembly of the pellet gun 207 seats the pellet 205 in the firing chamber of the gun. The bend 29 in the tube makes it easier to align the delivered pellet with the firing chamber entrance 204 so that the pellet 205 is in alignment when the bolt 206 is closed. The bend 29 must not interfere with the flow of the pellets 205 through the tube 201, but most pellets 205 are short enough so that a suitable bend 29 can be accomplished. In this embodiment a retention device 202 similar to 26 in FIG. 2A can be used to keep the pellets in position until they are delivered to the gun.

Retention of the pellets 22 shown in FIG. 2A and in FIG. 2B can be accomplished in several different ways, and embodiments of retention device construction and operation are shown in FIGS. 3A through 3I.

Figure 3A:
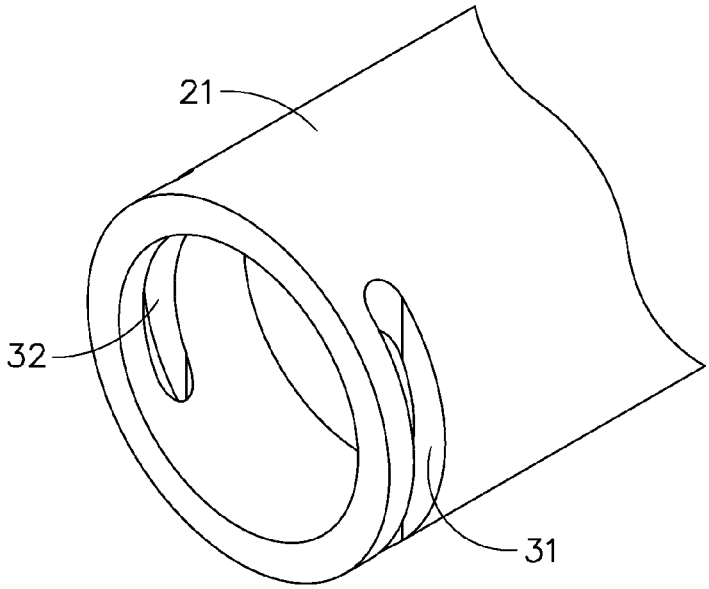
FIG. 3A is a dispenser tube with partial retention assembly.

In the FIG. 3A embodiment the retention device 26 is comprised of a slot 31 placed perpendicular to the axis of the tube 21 through one side of the tube 21 and a similar slot 32 placed perpendicular to the axis of the tube 21 through the other side of the tube 21, the slots 31, 32 being offset from the tube 21 axis. The material of the tube 21 remaining in the plane of the slots 31, 32 supports the tube 21. FIG. 3A comprises two slots 31, 32, but more slots or just one slot could be used.

Figure 3B:
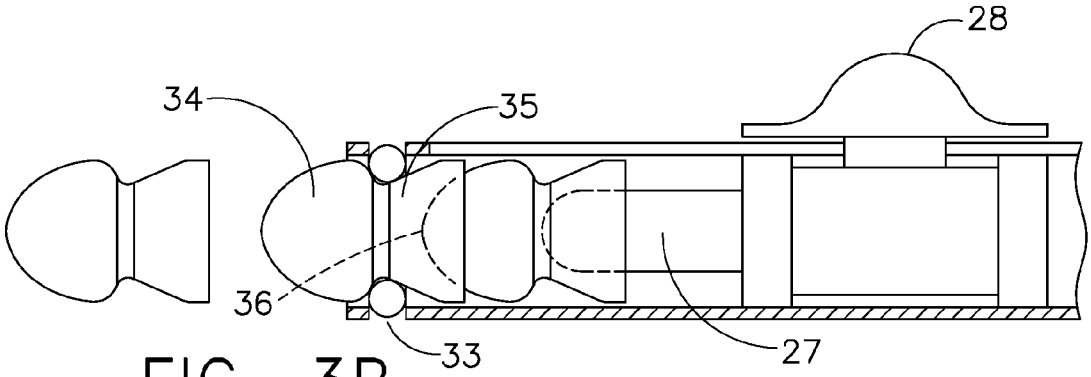
FIG. 3B is a retention assembly.
Figure 3C:
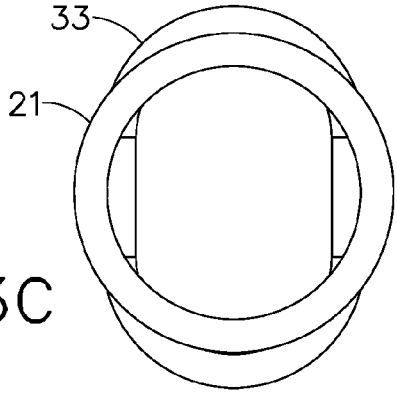
FIG. 3C is a retention assembly.

In FIG. 3B a flexible retainer 33 is placed through the slots. In the embodiment shown the flexible retainer 33 is a polymeric "O" ring placed around the tube 21 so that it rests in the slots 31, 32. The slots 31, 32 are made deep enough that neither the head 34 nor the skirt 35 of a pellet can pass through the retainer 33 unless forced through by an external force. Also, the force applied by the retainer 33 to hold the pellet in place is small enough that a pellet is not deformed when pressed through the retainer 33. The retainer 33 grips pellets by their waist 36 when they pass through the flexible material of the retainer 33 holding them in place until they are pushed on through. FIG. 3C shows the flexible retainer 33, in this case a polymer based "O" ring mounted in the slots 31, 32 as seen looking down the central axis of the tube 21.

Figure 3D:
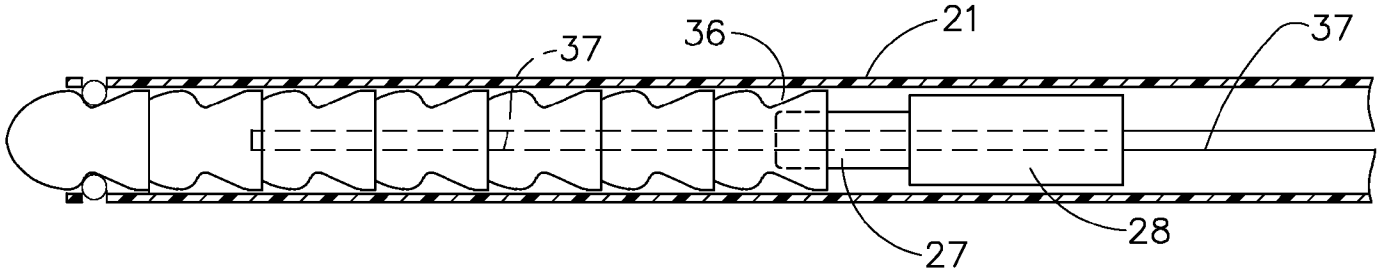
FIG. 3D is a pellet dispenser with pellets.

FIG. 3D shows a loaded tube with a plunger 27 pushing against the last pellet in the proximal end of the tube 21 as it passes through the tube 21 being guided by the traveling slot 37.

Figure 3E:
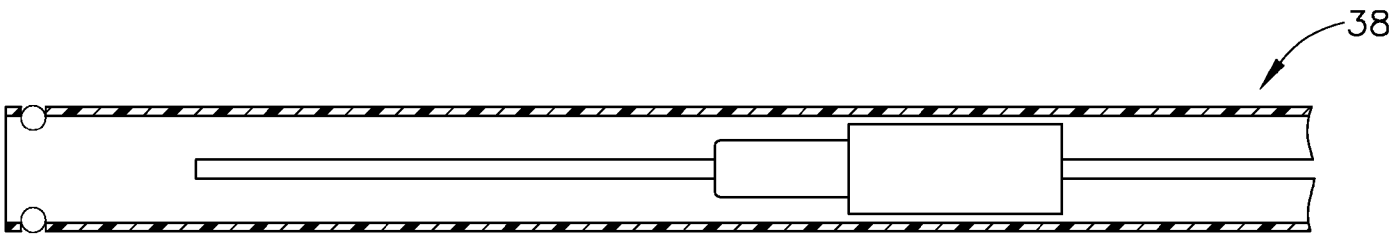
FIG. 3E is pellet dispenser without pellets.

FIG. 3E shows a dispenser 38 that is empty with no pellets in it. The plunger 27 is disposed in the tube.

Figure 3F:
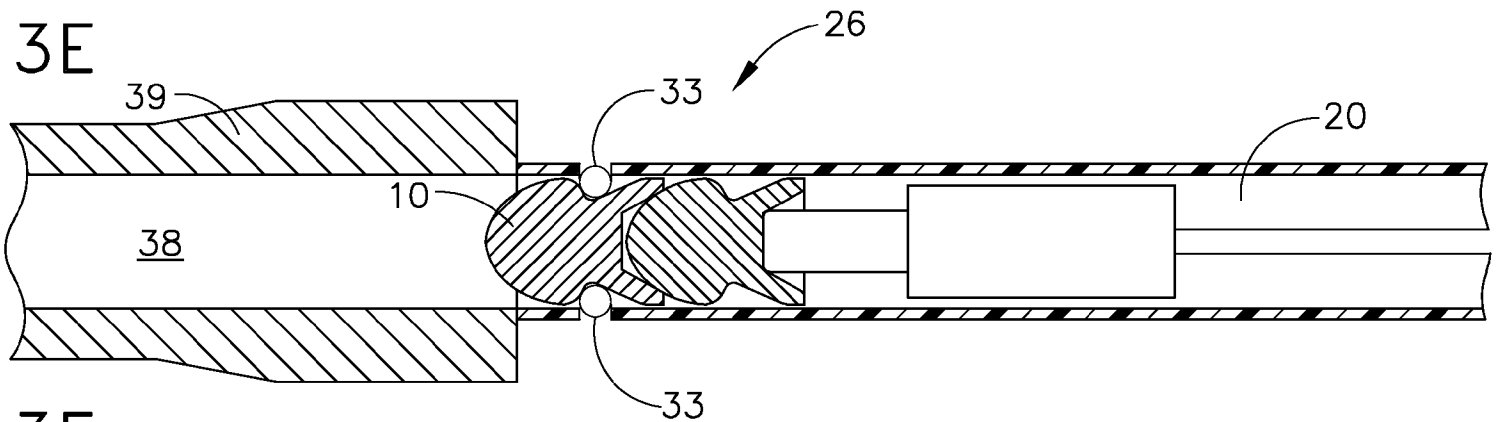
FIG. 3F is a pellet dispenser and pellet gun.

FIG. 3F shows a pellet 10 being loaded into the firing chamber 38 of a pellet gun 39 from a dispenser 20 as the last pellet 10 pushes the pellet 10 being loaded into the firing chamber 38 and moves into the retainer 33 of the retention device 26. This figure shows how a pellet 10 can actually be pushed into the firing chamber of a pellet gun by the dispenser 20. The figure could apply to a variety of pellet gun loading situations, for example, the chamber 38 shown could be that of a break barrel pellet gun 39.

The retainer 33 could comprise some other flexible material than an "O" ring. For example, a spring clip fitting through the slots could be used such as the escapement tabs 301 shown in FIG. 3G. In the figure flexible escapement tabs 301 are part of the tube 21. These escapement tabs 301 can be made of flexible springy material with tabs 302 arranged so that they retain the pellet 22 allowing the pellet 22 to pass only when pressed out of the dispenser 20.

Figure 3G:
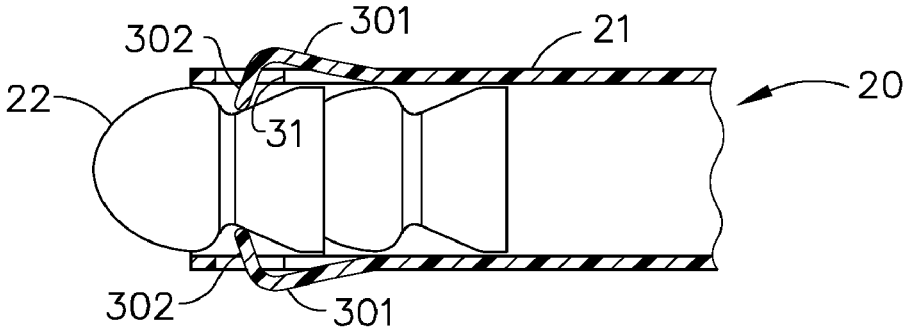
FIG. 3G is a retention device.

For example, the tabs 302 could be made of spring metal attached to the sides of a dispenser tube 21 or could be directly molded into the dispenser 20 in a plastic version as shown in FIG. 3G.

The free end 302 of the tab 301 extends into the slot 31 to retain the pellet 22 in place until it is pushed out of the dispenser 20. In FIG. 3G the tabs 301 are made so that they engage the pellet 22 in the slot 31 springing out to let the pellet 22 exit the dispenser 20 when the pellet 22 is pushed out from the rear and then springing back into place.

Figure 3H:
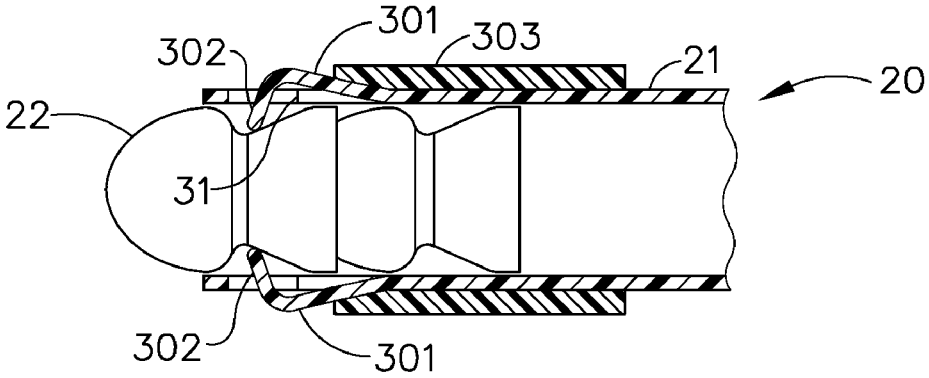
FIG. 3H is an adjustable retention device.

In another embodiment the action of the tabs 301 can be adjusted by fitting a tab control tube 303 around the dispenser tube 21 allowing the control tube 303 to engage the tabs 301 to control the action and the force of retention provided by the tabs 301 allowing adjustments for changes such as wear or material changes or inconsistencies. The control tube 303 can be friction fit to the dispenser tube 21 to hold the control tube 303 in the correct position as shown in FIG. 3H.

Figure 3I:
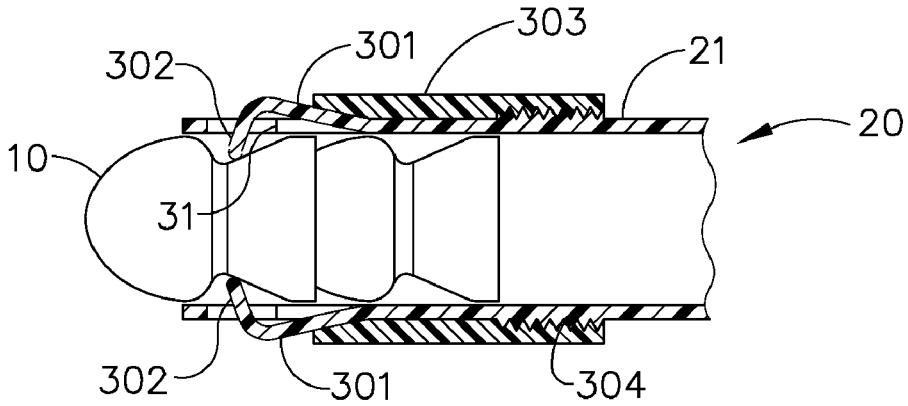
FIG. 3I is an adjustable retention device.

In a different embodiment shown in FIG. 3I a screw mechanism 304 can be used to adjust the engagement of the control tube 303 with the escapement tabs 301 allowing the engagement of the tabs' 301 free ends 302 to be adjusted as the tab ends 302 wear or as the inherent properties of the tabs 301 change over time.

Figure 4A:
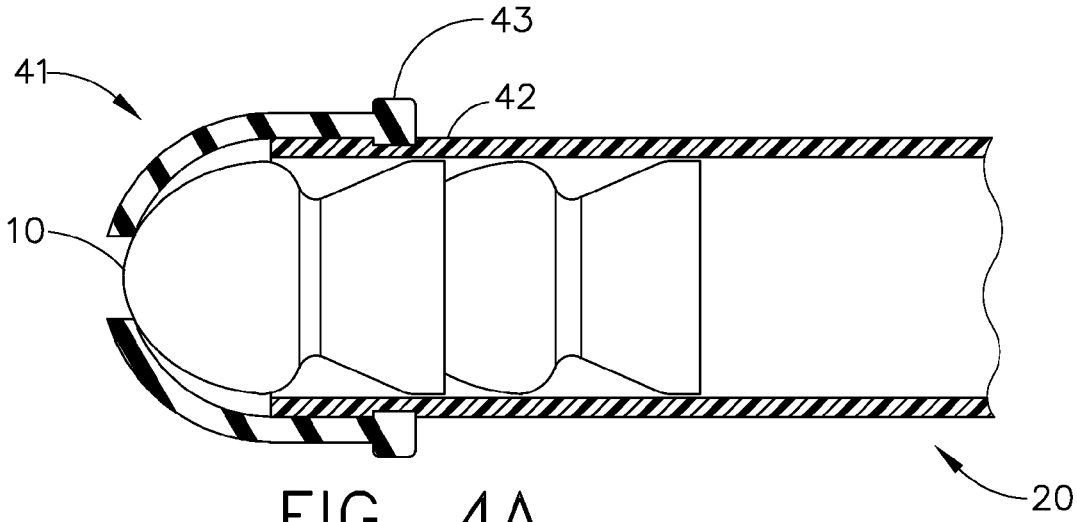
FIG. 4A is a retention device.

Many kinds of retention devices can be used for retaining the pellet 22 at the end of the tube. In another embodiment shown in FIG. 4A, the retention device 41 is a short piece of tubing 43 which has been stretched over the end of the dispenser tube 42. The figure shows a pellet 10 retained in the end of the tubing 43. The pellet 10 could be dispensed from the tube 42 by pushing on it with a plunger moving axially down the length of the tube 42. The tension of the tubing 43 on the pellets 10 as they pass through the tubing 43 can be adjusted by suitably notching or slitting the tubing 43 to adjust its grip on a pellet 10. In the embodiment shown a piece of silicone tubing 43 has been used for retaining the pellet 10. The silicone is a good choice for this application since it is slippery yet maintains a firm grip on the pellets allowing them to be dispensed one at a time. Nearly any elastic material could be modified for use as a flexible retainer by simply attaching it to the end of the tube 42 and adjusting its grip on the pellet 10.

Figure 4B:
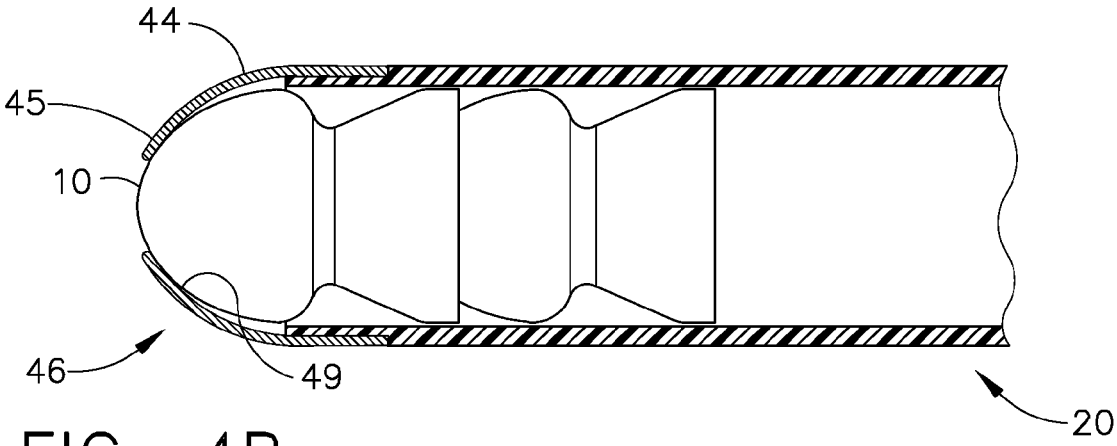
FIG. 4B is a retention device.

In another embodiment, shown in FIG. 4B, a toothed spring metal end 44 comprises the delivery mechanism of a dispenser 20. The spring metal teeth 45 hold the pellet 10 in position at the end of the dispenser 46 and spring open to allow a pellet 10 to pass when pressed from the rear springing back into position to retain the next pellet 47 in position for dispensing.

Figure 4C:
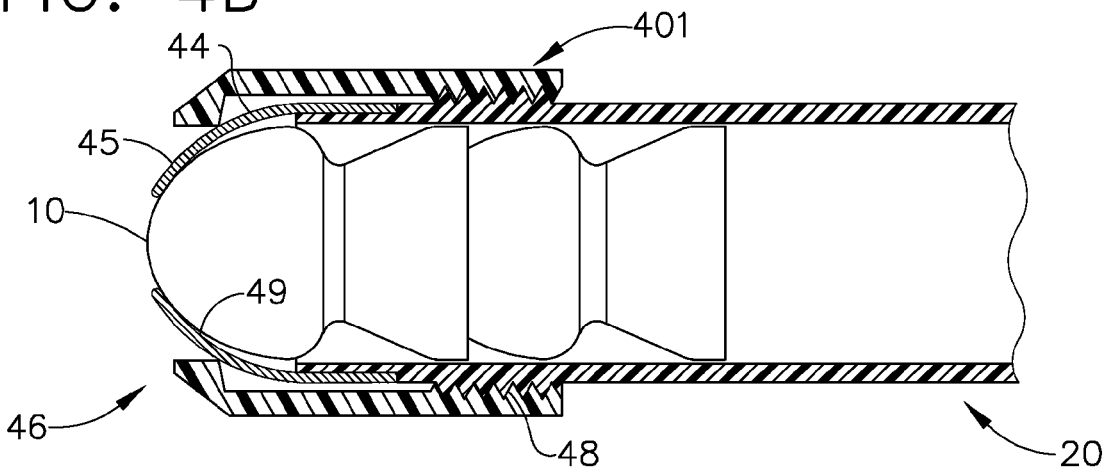
FIG. 4C is and adjustable retention device.

In another embodiment shown in FIG. 4C an adjustment device or collet comprising an end that is shaped inside 49 to engage the base of the teeth 45 using a screw mechanism 48 to adjust the springiness or tension of the teeth 45 against the retained pellet 10 is shown. This arrangement allows the dispenser 20 to be adjusted for varying pellets, wear, and changes in the material comprising the dispenser. In some cases the adjustment mechanism 401 can even be used to adjust the dispenser enough to accommodate varying calibers of pellets 10.

However, it is often found that the dispenser works best when it is made specifically for the caliber of pellet being used. This is especially true for dispensers designed for break barrel pellet gun designs wherein a seating pin 212 is used.

Varying plunger systems can be used to press the pellet 10 through the retention device. At the opposite, proximal, end of the tube 21 from the retention device 26, a plunger 27, as shown in FIG. 2A, is placed against the skirt of the last pellet to push the pellets toward the retention device 26 located at the distal end of the tube. The plunger 27 can be indexed for positive action with just enough advancement of the plunger 27 on each stroke to push one pellet out of the tube. Alternatively, the plunger 27 does not have to provide indexing action since the action of the retention device 26 is sufficient to allow control of the dispensing action of the tube assembly reliably permitting the operator to deliver one pellet 22 at a time.

Figure 5:
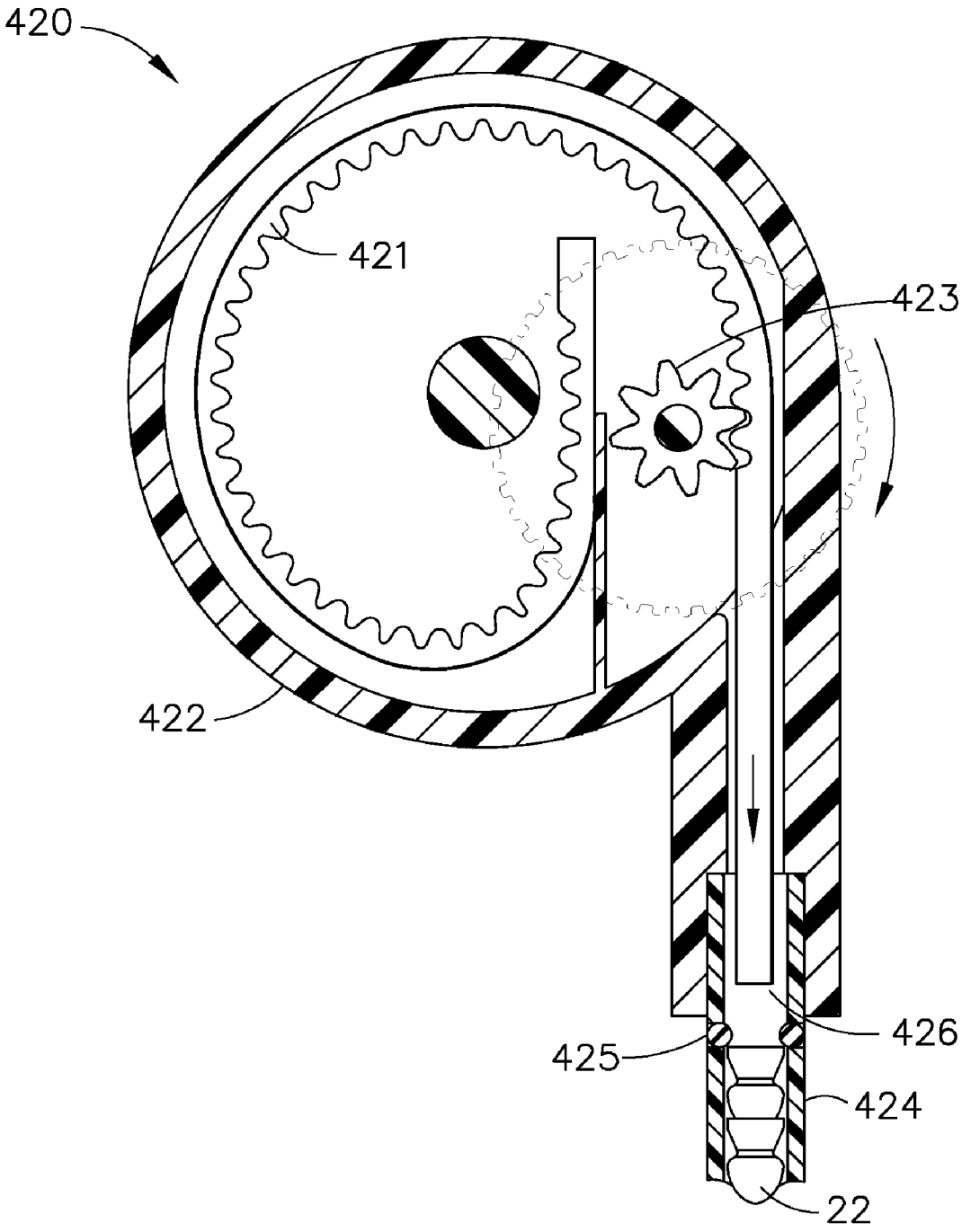
FIG. 5 is a flexible coil pellet plunger.

In another embodiment as shown in FIG. 5 the plunger 27 can be replaced with a flexible coil pellet plunger 420. The plunger 420 can be removable from the pellet dispenser 20 and offers the advantage that by using the flexible coil plunger 420 more pellets can be added to the dispenser tube 21. Since the original plunger 27 can be as long as several inches, the dispenser capacity can be enhanced without adding length to the dispenser 20. Making the flexible coil pellet plunger 420 attachable and removable on pellet dispenser tubes 21, means that if a user has a number of tubes 21, more pellets 22 can be stored and loaded without adding unnecessary length to the tubes 21 or adding to the bulkiness of the tubes 21. In this case a removable version of the pellet seating device 209 must be used to allow the flexible coil plunger 420 to be fitted over the end of the tube 21.

The flexible coil pellet plunger 420 is comprised of a coil of flexible material 421 arranged in a carrier 422 which is fitted with a thumb operated drive mechanism that can be either tooth driven or friction driven. In the example shown in FIG. 5 a toothed drive mechanism is fitted to the apparatus using a thumb wheel solidly attached to a drive gear 423 and protruding from the case 422 to insure that the thumb of a user pulls the plunger 420 toward the dispenser tube 424 when it is operated to push pellets 22 through the dispenser 424. As will be seen in FIG. 5, the end of the dispenser tube 424 can be fitted with a restrictor 425 to keep the pellets 22 from falling out of the dispenser tube 424 when the plunger 420 is not attached. In addition the outlet of the flexible coil carrier 426 can be made large enough to fit over the end of the dispenser tube 424 to keep the coil 421 in good alignment with the pellets 22 on which the coil 421 is pushing.

In any case the user of the dispenser does not have to touch the pellets while loading them. Avoiding hand contact with the pellets, and instead, providing a device that reliably delivers and places oriented pellets one at a time is a real advantage making shooting single shot pellet guns much easier, much more effective and, often, more fun. In addition when used in hunting, a dispenser can add greatly to the stealth of the hunter.

Figures 6A, 6B:
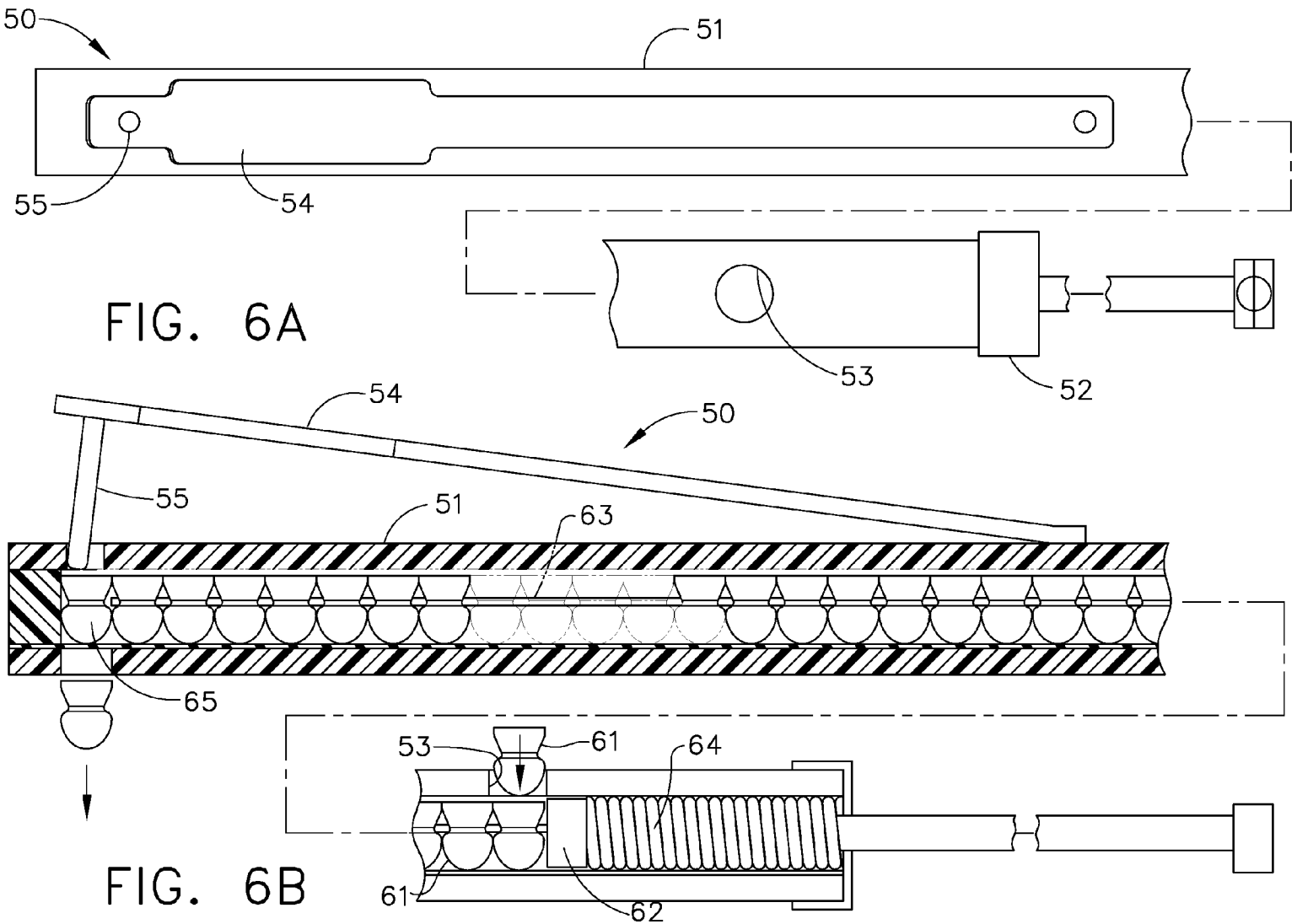
FIG. 6A is a pellet dispenser.
FIG. 6B is a pellet dispenser.

In yet another embodiment a tube is constructed to allow side discharge of the pellets using a finger actuated plunger. This is often desirable when one must reach into a pellet gun to place a pellet at a difficult angle. However, this embodiment can be used in nearly any pellet gun loading situation. In this embodiment a tube is provided with additional structure. FIG. 6A is the outside of the assembled dispenser 50 showing the tube 51 with an end cap 52 for covering a loading hole 53 and a spring loaded plunger 54 which comprises a plunger prong 55 for dispensing pellets from the dispenser 50. In the embodiment shown the end cap 52 can be removed from covering the loading hole 53 for loading the dispenser 50. When the end cap 52 is in place, it prevents the loaded pellets from falling out of the dispenser 50. The end cap 52 can also be replaced by the removable version of the pellet seating device 209 by suitable shaping the end of the seating device to fit over the end of the dispenser tube 51.

FIG. 6B shows the construction of the tube and the basic operation of the dispenser 50. As shown, pellets 61 are loaded into the dispenser 50 through the loading hole 53, and they pass through the tube 51 oriented with their axis of symmetry perpendicular to the tube 51. In this embodiment a spring loaded piston 62 pushes the pellets 61 along the length of the tube. Since sometimes the pellets 61 are of almost the same diameter as length, the pellets 61 must be constrained to maintain their orientation in the tube 51, or they will tend to tumble end over end in the tube and lose their orientation in the dispenser 50.

When the pellets 61 reach the end of the dispenser 50 at the distal end of the tube 51 opposite the loading hole 53, they are retained in the tube until they are pressed out of the tube by the spring loaded plunger 54.

To maintain the orientation of the pellets as they move down the tube 51, the tube is provided with a thin guide strip 63 that engages the waist of each pellet as it moves through the tube 51 constraining it to remain in its orientation which maintains the pellets 61 in alignment skirt-to-skirt and head-to-head as they travel through the tube 51. The guide strip 63 can comprise a thin channel through which the pellets move that engages the waist of the pellets 61 on both sides, or it can be a strip that merely engages one side of the pellet 61 pushing it against the wall of the tube 51 on the other side. In any case the guide strip 63 must engage the waist of the pellets 61 and hold them in orientation. The spring loaded piston 62 must be modified to accommodate the guide strip 63 as it extends into the inside of the tube 51 to prevent damaging the guide strip 63 as the pellets 61 are pushed along the length of the tube 51.

Alternatively, the dispenser 50 can be configured with a guide running substantially the length of the dispenser 50 that is shaped in the approximate profile of a pellet to keep the pellets in proper orientation inside the dispenser 50.

Figure 7:
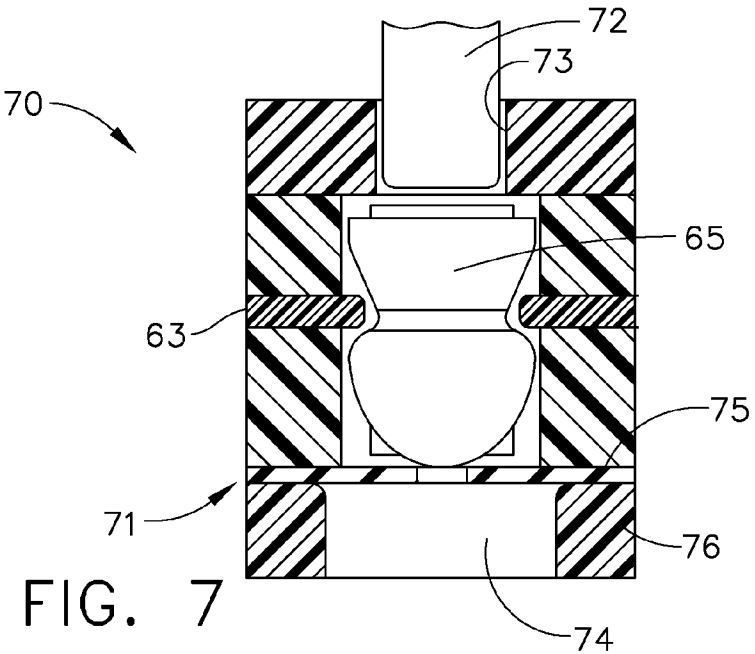
FIG. 7 is a pellet dispenser retention device.

FIG. 7 shows the construction detail of the distal end of the tube 70 opposite the loading hole 53 in the proximal end of the tube. The cross-sectional shape of the tube 51 is arbitrary since the guide strip 63 in the tube 51 keeps the pellets 61 oriented. The end of the tube 70 comprises a retention device 71 for keeping the pellets 61 in the tube 51, a plunger prong hole 73, through which the plunger prong 72 passes to push the pellets 61 out of the tube 51 and the supporting structure of the tube 51.

In this embodiment the retention device 71 is comprised of a thin sheet of flexible material that is held against the exit orifice 74 of the tube 51. The flexible material 75 provides enough flexibility to allow the pellet 61 to be pushed out of the tube by the plunger prong 72 but holds the pellet 61 in the tube 51 until it is pushed out by the plunger prong 72. It should be noted that the guide strip 63 need not be flexible. The guide strip 63 can end at the last pellet before the pellet in the end of the tube 65 and does not have to extend to hold the pellet in the end of the tube 65 in orientation. Rather, the pellet in the end of the tube 65 is held in place by the piston 62 and piston spring 64 pressing against the pellets 61 in the dispenser.

For the piston 62 to slide the length of the tube, it must be shaped or modified to allow for the presence of the guide strip 63 so that the piston 62 can slide in the tube 51.

If the guide strip 63 is made of suitable material with enough flexibility to allow the release of the end pellet 65 under the action of the plunger 54, the guide strip can extend either part way or completely across the location of the end pellet 65. In this case it can be possible to eliminate the thin sheet of flexible material 75 altogether or the guide strip 63 and the flexible material 75 can both be used to retain the pellet 65.

The thin sheet of flexible material 75 can be attached around the exit orifice 74 in various ways. For example, it could be a piece of tubing covering the entire tube 51, or it could be a small piece of flexible material just covering the area of the exit orifice, or it could be of other arbitrary shape so long as it covers the exit orifice 74 in a manner that allows the pellets to be dispensed from the retention device 71.

Under the action of the plunger 54 in FIG. 6B, the pellets 61, 65 can be dispensed in orientation, and sometimes the dispenser need only comprise either the guide strip 63 or the flexible material 75 or both to operate and load effectively. However, FIG. 7 shows an offsetting spacer 76 covering the thin sheet of flexible material 75. This offsetting spacer could be a tube covering the dispenser or could be something as simple as a washer attached over the exit orifice to provide the offset.

In applications where the dispenser is placed directly in contact with the entrance to the firing chamber of a pellet gun this offsetting spacer 76 can sometimes be necessary to the operation of the dispenser 50. The offsetting spacer 76 keeps the sides of the thin sheet of flexible material 76 from interfering with the loading action as the sides of the flexible material 75 are deformed toward the outside of the dispenser 50 when the pellet is ejected from the dispenser 50. The offset prevents the flexible material 75 from extending outside the outer surface of the dispenser 50 where it could interfere with placement of a pellet 61 or could even enter the firing chamber of a pellet gun jamming the pellet and/or the gun.

The dispenser 50 can place pellets 61 in specific locations without touching them with one's hands. Further, it is possible to place the pellets 61 with the precision needed to efficiently load pellet guns.

Figure 8:
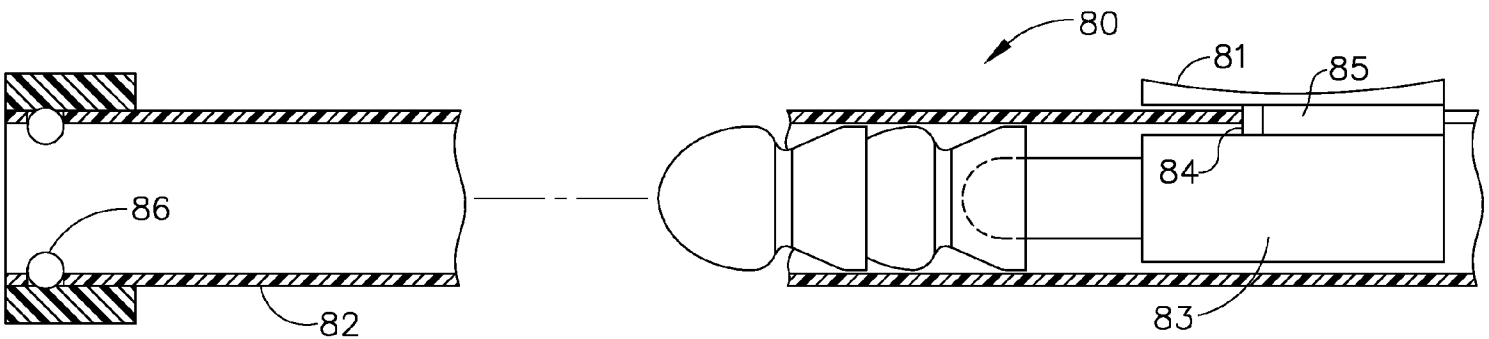
FIG. 8 is a pellet dispenser.

It should be noted that dispensers of the type described so far can be made in either reloadable form or can be designed for single use applications. The dispensers described above are all presented in reloadable form. However, single use applications can be important where safety issues or limited fire issues are involved. For example, as shown in FIG. 8 a dispenser assembly 80 can be made with a plunger 83 and a plunger handle 81 that extends through the side of the tube 82. The connector 85 that connects the plunger 83 to the plunger handle 81 comprises a tube splitter 84 that splits the tube as the plunger 83 is moved down the tube destroying it and making it incapable of being reloaded.

In another embodiment of a self destructing dispenser 80, a spring loaded retention pin 86 engages the plunger 83 as the last pellet is ejected immobilizing the plunger 83, and the plunger 83 is inaccessible without destroying the dispenser.

These destructive embodiments are examples of methods for self destroying the dispenser 80. One skilled in the art can envision many methods for making dispensers not reusable.

Other embodiments of the invention can comprise assemblages of layers of materials with plungers for pushing stored pellets from the discs while providing orientation of the pellets as needed.

Figure 9:
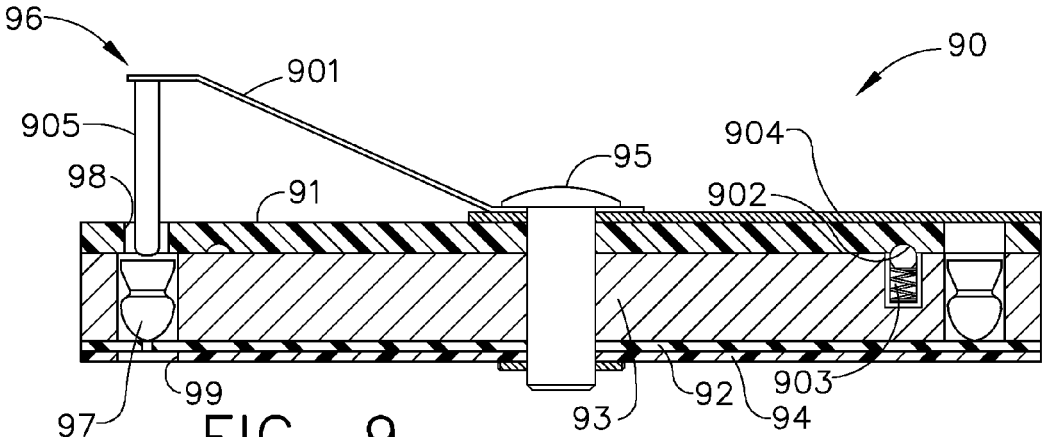
FIG. 9 is a pellet dispenser.

In one embodiment shown in FIG. 9 four layers of circular discs comprised of various materials are stacked and mounted together axially 90. The apparatus 90 is comprised of two outer discs with durable surfaces 91, 92, one inner disc capable of storing pellets in oriented position 93, and a disc comprised of flexible material 94. The discs are bound together using an axial mount 95. A spring loaded plunger with plunger prong 96 is also mounted on the axial mount 95 as shown in FIG. 9. In this embodiment the bottom three discs 92, 93, 94 are secured together and they rotate together. They can also be secured to the axial mount 95, or they can rotate about the axial mount 95 together. The top disc 91 and the spring loaded plunger 96 rotate independently about the axial mount 95. The storage disc 93 can be loaded about a circumference such that the spring loaded plunger 96 can access the storage locations of the pellets 97 and can dispense them individually. The pellets 97 can be stored in holes drilled in the disc 93 to hold the pellets 97 in orientation.

A loading cover 904 can be incorporated in the dispenser 90. The cover restricts the pellets 97 from falling out of the top of the dispenser 90 by partially covering the plunger hole 98 leaving a space for the plunger prong 905 to pass through the cover 904 and squarely engage the pellet 97. To reload the dispenser 90 the loading cover 904 and the plunger 96 can be pushed aside while pellets are inserted into the dispenser 90 coming to rest in the storage disc 93 while waiting to be dispensed. After loading is complete, the loading hole cover 904 and the plunger 96 can be pushed back into place over the plunger hole 98 The loading cover 904 can be made of flexible or spring-like material with a detent that drops down inside the plunger hole 98 to keep it located in the hole 98.

Alternatively, the disc 93 can be made of a material that will grasp and hold the pellets 97 in the orientation desired for dispensing. In the embodiment shown the pellets are stored in holes of a size that will hold them in proper orientation. The top disc 91 holds the pellets in the storage disc until they are accessed by the single hole in the top disc 91 at which the plunger 96 is positioned to pass through the hole 98 and push the pellets 97 through the exit orifice 99. The pellets are retained in the storage disc by the top disc 91 and by the flexible material disc 94 which retains the pellets 97 by holding them in the storage disc until they are pushed out of the disc assembly 90 by the plunger 96.

The storage holes in the storage disc 93 are congruent with holes in the discs under it 92, 94. As in the discussion of FIG. 7, the hole in the flexible material disc is small enough to retain the pellet 97 until it is pushed out of the disc assembly 90 by the plunger 96. Again, as in the discussion of FIG. 7, a bottom offset disc 94 can be necessary and must be of sufficient thickness to preclude the deformed flexible disc 92 from protruding below the offset disc 94 during dispensing. This is to prevent misalignment or jamming during delivery.

The orientation of the top disc 91 and the spring loaded plunger 96 can be indexed using detents 902 in the top disc 91. An arrangement for doing this is shown in FIG. 9 which employs a spring loaded indexer 903 positioned in the bottom discs 92, 93, 94 engaging the detent 902. While helpful in some applications, such a detent apparatus 902, 903 is not always necessary for the operation of dispensing from the disc assembly 90.

When the plunger 96 and plunger hole 98 are placed over one of the storage holes in the storage disc 93, the plunger is pushed and a pellet 97 is delivered without the pellet 97 touching one's fingers. Additionally, because the holes can be positioned over a break barrel design pellet gun firing chamber accurately, the pellets can be delivered with precision to the pellet gun chamber. A removable version of the pellet seating device 209 can also be used to aid in precision placement of the pellet 97.

In another embodiment the plunger arm 901 can be designed to permit the plunger 96 to be moved radially approaching or departing the axial mount. Using this action additional disc area can be exposed to the action of the plunger permitting pellet storage to be accomplished in a larger portion of the storage disc 93.

Figure 10A:
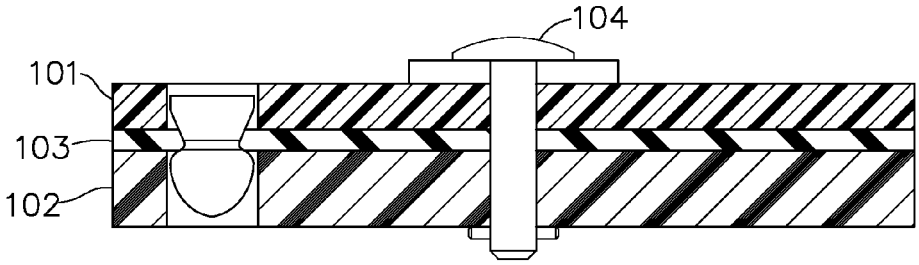
FIG. 10A is a pellet dispenser assembly.
Figure 10B:
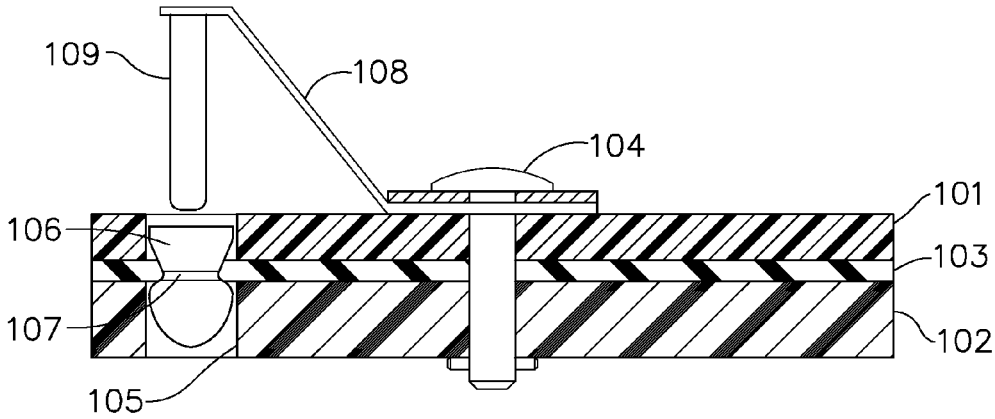
FIG. 10 B is a pellet dispenser.
Figure 10C:
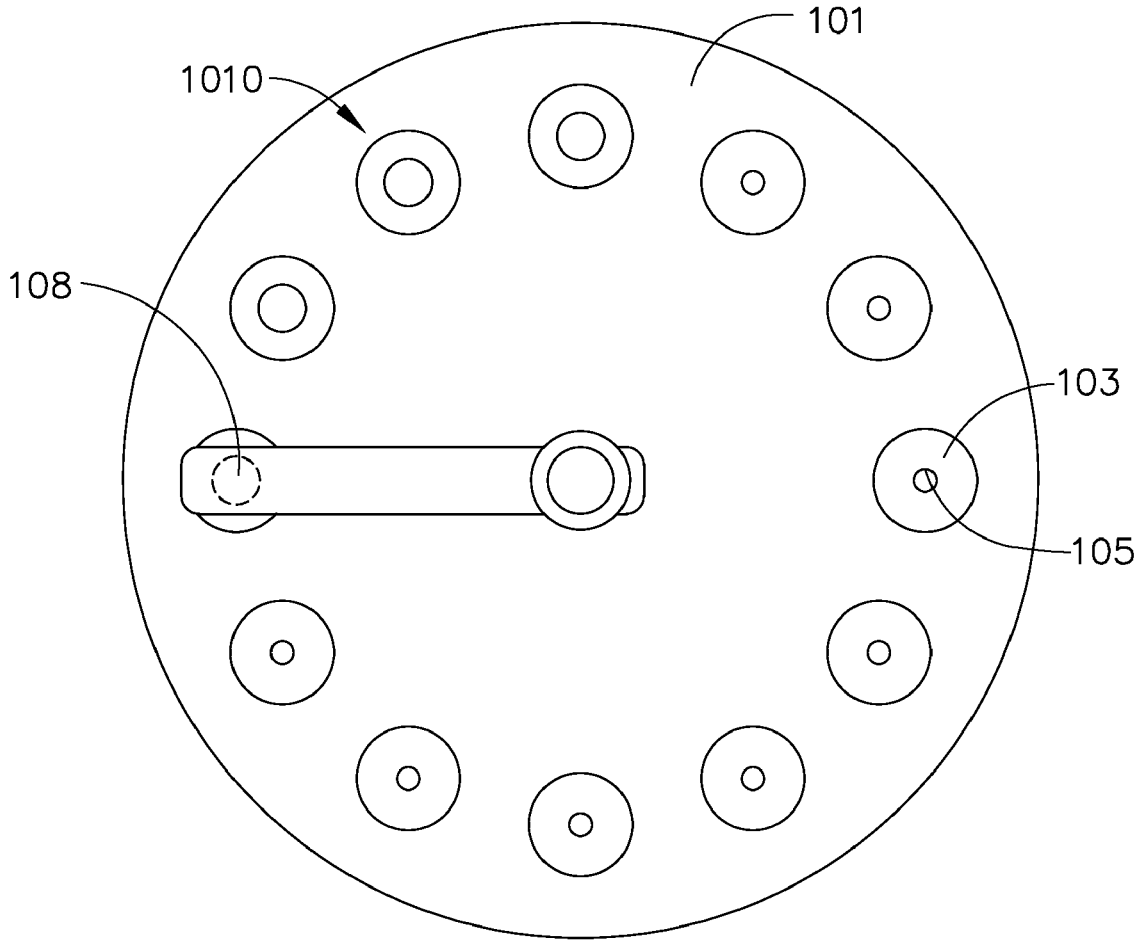

In yet another embodiment a different assemblage of discs to make a dispenser is shown in FIG. 10A-C. This embodiment comprises only three discs as shown in FIG. 10A.

Two outer discs 101, 102 of reasonably hard durable material sandwich a third disc 103 of flexible material such as a thin silicone disc. The discs 101, 102, 103 are secured together so that they cannot move with respect to each other and an axial mount 104 passes through their center.

A circle of holes 105 only slightly larger than the diameter of a pellet as shown in FIGS. 10B and 10C is distributed about the axial mount 104 each placed radially at an equal distance from the axial mount 104. The middle disc 103, made of suitably flexible material, is of a thickness appropriate to engage a pellet 106 at its waist 107. In this embodiment the flexible material extends into the holes 105 that passes through the upper disc 101 and lower disc 102 to engage the pellet 106 by its waist 107. The thin flexible material of the disc 103 when supported by the upper disc 101 and lower disc 102 holds the pellet 106 in place in its desired orientation until it is pushed out of the hole.

A spring loaded plunger 108 is mounted coaxially with the discs 101, 102, 103 on the axial mount 104. The axial plunger 108 is free to move about the axial mount 104 in a circle to engage the holes in the disc shown in FIG. 10C.

When the plunger 108 is located over a hole containing a pellet 1010 and is pressed by the operator, the plunger prong 109 communicates with the pellet 106 driving the pellet 106 out of the flexible material 103, maintaining its orientation, and dispensing the pellet 106 as oriented. In this way pellets 106 can be delivered with precision and accuracy directly to the firing chamber of a pellet gun. As before, the bottom disc 102 must be of sufficient thickness to preclude the deformed flexible material of disc 103 from extending below the outside of disc 102 during delivery.

Figure 11A:
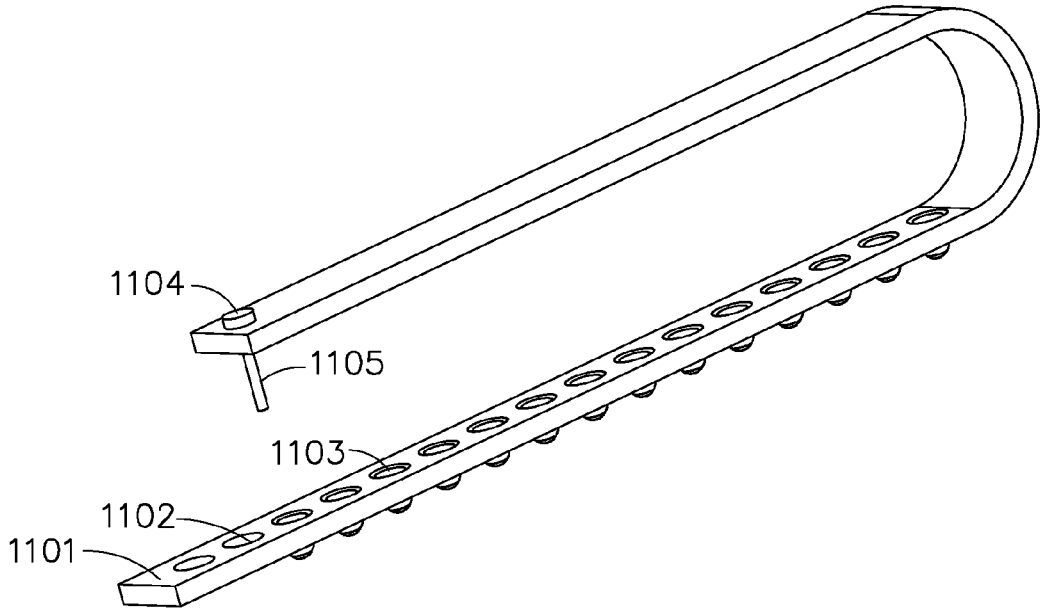
FIG. 11A is a pellet dispenser.
Figure 11B:
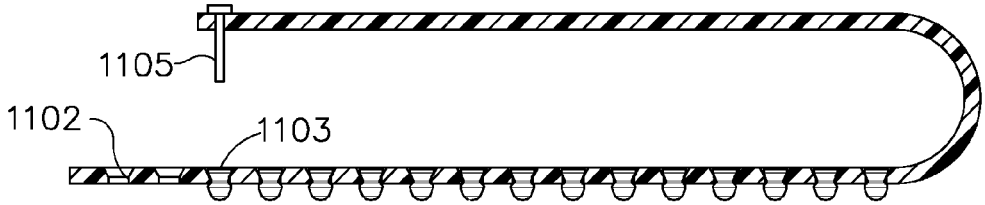
FIG. 11B is a pellet dispenser.
Figure 11C:
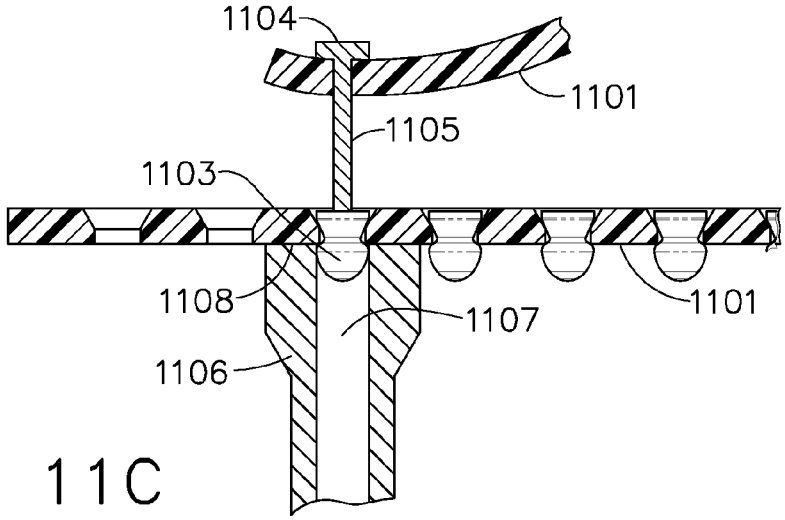
FIG. 11C is a pellet dispenser with pellet gun firing chamber.

In another embodiment FIGS. 11A and 11B provide a flexible material used to make a strap 1101 having holes 1102 of a size suitable to engage and hold pellets 1103 in place. Mounted in the strap is a plunger 1104 with a plunger prong 1105. The strap 1101 and the plunger prong 1105 are sized so that the plunger can be placed in the skirt of a pellet 1103 to drive it out of the hole 1102 in the strap 1101 into the firing chamber 1107 of a pellet gun 1106 as shown in FIG. 1*l* B. The pellet seating device 209 could be mounted replacing the plunger 1104 and prong 1106 to improve pellet 1103 placement and location. In this embodiment placement of the pellet 1103 is enhanced because the head of the pellet 1103 can actually be placed in the firing chamber 1107 before the plunger 1104 is used to push the pellet 1103 home into the firing chamber 1107. In this case extension of the flexible material into the chamber of the pellet gun 1106 is not a concern since the break barrel surface 1108 outside the firing chamber supports the flexible material of the strap 1101 sufficiently to preclude its entry into the firing chamber 1107 and avoids possible pellet 1103 or pellet gun 1106 jams.

It should be noted here that the plunger 1104 and prong 1105 or the pellet seating device 209 can also be used to place pellets 1103 into the holes in the strap 1101. When the pellets 1103 are pushed into the strap 1101, they are gripped at the waist by the strap 1101 and remain there until forced out by a second push that seats them in the firing chamber in the case of a break barrel gun design.

Figure 12A:
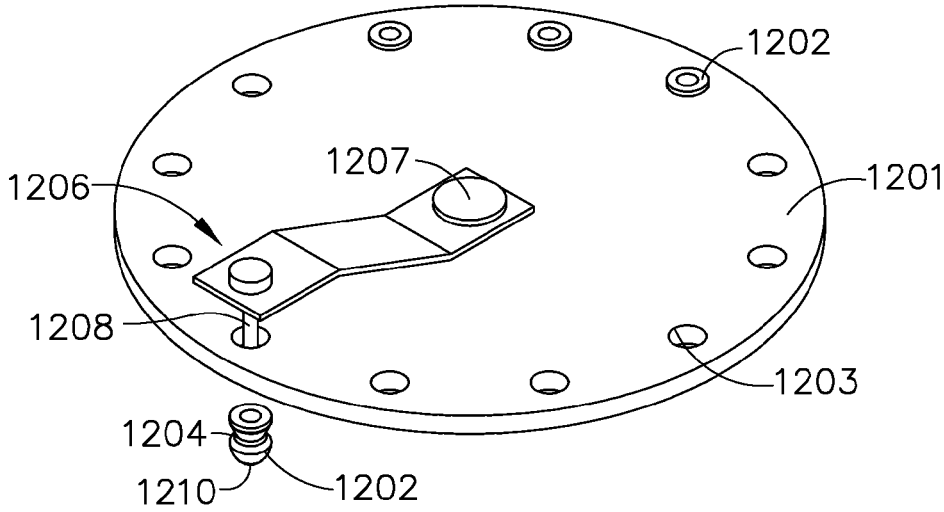
FIG. 12A is a pellet dispenser.

From another aspect, a flexible material can be cut into a disc 1201 as shown in FIG. 12A. Pellets 1202 can be loaded into holes 1203 in the disc that are of a size that will allow the holes 1203 to engage the waists 1204 of the pellets 1202.

Figure 12B:
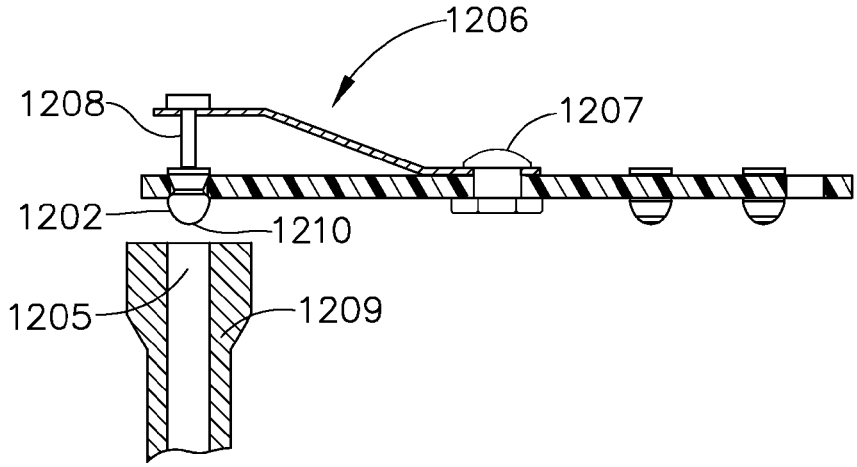
FIG. 12B is a pellet dispenser with pellet gun firing chamber.
Figure 12C:
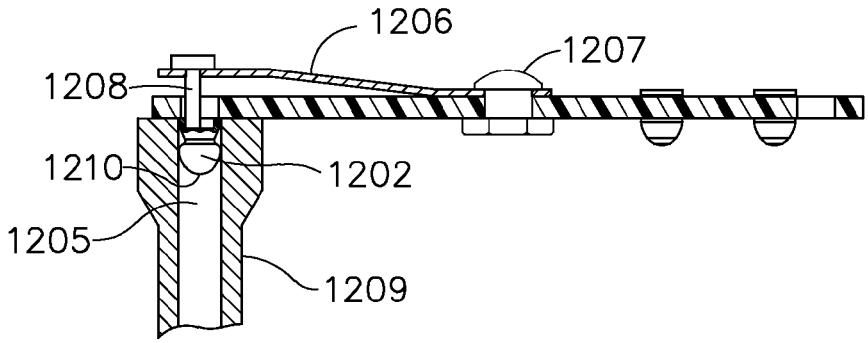
FIG. 12C is a pellet dispenser with pellet gun firing chamber.

The pellets 1202 can then be loaded into a pellet gun firing chamber 1205 from the disc 1201 as shown in FIGS. 12B and 12C. In this embodiment a spring loaded plunger 1206 is mounted on an axial mount 1207 in the center of the disc. The plunger 1206 has a plunger prong 1208 for engaging the skirt of the pellet 1202 and driving it out of the flexible material. It should be noted that the plunger 1206 and its prong 1208 can also be used for placing pellets into the disc 1201 of flexible material thus loading the flexible material with pellets 1202. This allows the dispenser to be reloaded and be reused.

To load a pellet 1202 into a break barrel pellet gun 1209 the spring loaded plunger 1206 and plunger prong 1208 are aligned over the pellet gun firing chamber 1205. The head of the pellet 1210, which extends out of the flexible material, is placed in the entry of the pellet gun firing chamber 1205 and the pellet 1202 is pushed into the firing chamber 1205 using the plunger 1206. In this way precision and accuracy are achieved in delivering the pellet 1202 to the firing chamber eliminating all the difficulties in trying to do it by picking the pellets one at a time and placing them with the fingers. Precision placement can even be improved if the pellet seating device 209 is used to seat the pellets. The pellet seating device 209 can be used to replace the plunger prong 1208 adding additional precision to the placement of the pellets.

It should be noted herein that the flexible material approach described by FIGS. 11A-B and 12A-C can also be used to deliver the pellets 1202 to the pellet gun by pushing the pellets through the flexible material with a finger instead of using the plunger. However, this almost always leads to frustration after just a few pellets are loaded due to the range of problems mentioned above which comprise pellets sticking to the fingers and getting misaligned or withdrawn, dirty fingers, and jams due to pellets being pushed unevenly. Again, these problems can be avoided by using a properly shaped version of the pellet seating device 209.

Figure 13:
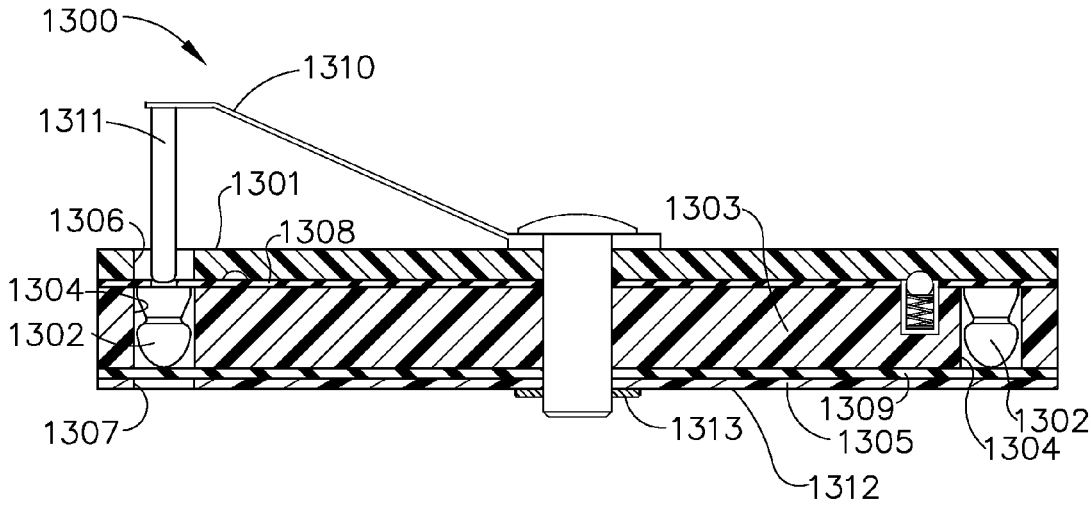
FIG. 13 is a pellet dispenser.

Another embodiment shown in FIG. 13 comprises three circular discs to form a dispenser 1300. The top disc 1301 is comprised of a durable material such as hard not easily deformed plastic or paper. The middle disc 1303 is a storage disc 1303 with a circle of holes 1304 of proper size for storing oriented pellets 1302 keeping them in the desired orientation. The bottom disc 1305 is comprised of a durable material. The three discs 1301, 1303, and 1305 are bound together by an axial mount 1313. In this embodiment the middle storage disc 1303 is permitted to rotate, but the top disc 1301 is held immobile with respect to the bottom disc 1305. Both the top disc 1301 and the bottom disc 1305 have a single hole 1306, 1307. The bottom hole or exit orifice 1307 is the same size as or slightly larger than the storage holes 1304 that contain the pellets 1302. The top hole 1306 is of a size that will permit a plunger 1310 mounted axially on the axial mount to pass its plunger prong 1311 through the hole. The two holes 1306, 1307 are held immobile in alignment with each other by the axial mount 1313. The middle storage disc 1303 is loaded with pellets 1302 and is sealed on the top with a thin pierceable sheet 1308 and on the bottom with a thin pierceable sheet 1309.

The dispenser 1300 is operated by orienting a hole containing a pellet 1304 in the storage disc 1303 under the plunger prong 1311. When the plunger 1310 is pressed, the plunger prong 1311 pierces the thin pierceable sheet 1308 and presses the pellet 1302 through the bottom thin pierceable sheet 1309 and out the exit orifice 1307. In some applications the bottom disc 1305 must be of sufficient thickness to prevent the broken and deformed bottom pierceable sheet 1309 sides from passing below the bottom 1312 of the bottom disc 1305 so that parts of the bottom pierceable sheet 1309 do not engage a pellet gun loading site and jam the gun.

The storage holes 1304 can be indexed into position by means of registration such as a system of detents on the discs 1301, 1303, 1305 or a system of locators on the axial mount 1313.

In yet another embodiment the dispenser of FIG. 13 can be made in a reusable form. In this embodiment the thin pierceable sheet 1308 on top of the storage disc 1303 is removed and the spacing between the top disc 1301 and the storage disc 1303 is held small enough so that the pellets 1302 in the disc 1303 cannot fall out. The bottom pierceable sheet 1309 is also removed and replaced by a thin sheet of flexible material such as a silicone rubber which is attached to the bottom of the storage disc 1303. The flexible material has retention orifices in it that are in registration with the holes 1304 in the storage disc. These retention orifices are small enough to retain the pellets 1302 in the storage disc 1303 but allow them to pass if they are pushed through the bottom of the dispenser 1300 by the plunger 1310. In addition the plunger 1310 is released so that it can be pushed aside the top disc hole 1306. By pushing the plunger 1310 aside, pellets 1302 can be loaded in the storage disc 1303 through the top disc hole 1306 where they will remain in orientation until they are pushed out of the dispenser 1300 by the plunger 1310 after it is repositioned over the top disc hole 1306. The plunger prong 1310 can be formed so that the plunger prong 1311 extends part way down into the top disc hole 1306 but not down far enough to engage the pellet storage disc 1303 thus blocking any pellet 1302 from falling out of the storage disc during handling before the pellet 1302 is dispensed.

As before, by placing additional hole circles around the storage disc 1303 and additional access holes like 1306, 1304, and 1307 in the top and bottom discs along with providing radial movement of the plunger 1310 the capacity of the dispenser 1300 can be increased.

Figure 14:
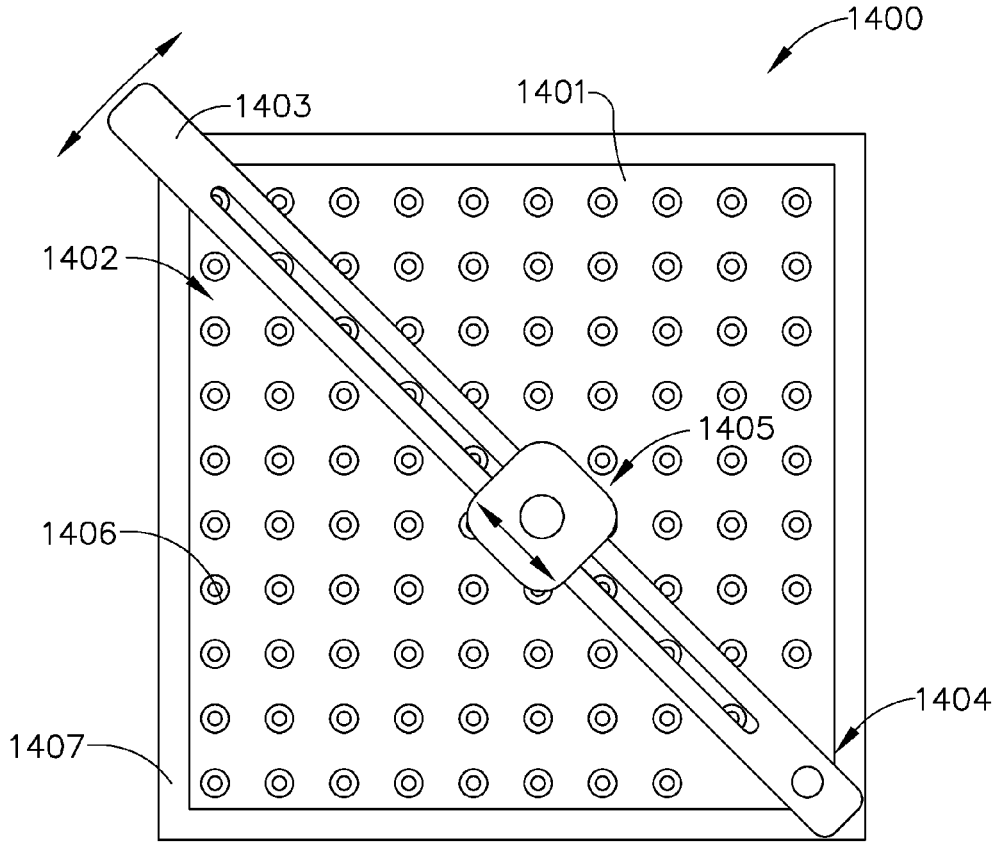
FIG. 14 is a pellet dispenser.

In another embodiment FIG. 14 shows how a dispenser of arbitrary shape can be made. In FIG. 14 a rectangular shaped dispenser 1400 is shown for example, but any shape could be used. The dispenser 1400 is based on the same kinds of retention and delivery considerations as above. A sandwich of outer layers and inner layers comprising flexible retention materials, pierceable sheets, and the like could be used, or a single layer of material able to engage pellets to hold them and deliver them in desired orientation could be used. But in the case shown a sandwich of materials such as the disc components above are used with a top outer layer 1401, a storage layer and an offset layer provided. These assemblies can include any of the above means of retaining the oriented pellets in holes of a size to retain orientation in the storage layer and to allow retention of orientation upon dispensing the pellets such as to a pellet gun firing chamber.

In the embodiment an array of storage locations or holes 1402 is provided for loading, storing, and delivering pellets stored in a storage layer. A pivotable alignment bar 1403 is provided and allowed to pivot around a pivot assembly 1404. The pivot assembly 1404 could be located anywhere on the dispenser 1400, but in FIG. 14 it has been located on the corner. The alignment bar has been provided with a slidable plunger assembly 1405 which can move along the alignment bar 1403. Movement of the alignment bar 1403 with the movable plunger assembly 1405 allows the dispenser 1400 operator to reach the position of any storage hole assembly in the dispenser 1400 with the plunger assembly 1405.

The position of each hole 1406 does not have to be indexed by the dispenser 1400 to be operated. The user need only see some registration of each hole on the top 1401 of the dispenser 1400 to reach it with the alignment bar 1403 and plunger assembly 1405.

However, as shown in FIG. 14 a raised edge 1407 is provided around the outside of the dispenser 1400 for the alignment bar 1403 to slide along. The raised edge 1407 can be provided with detent means to register the position of the alignment bar 1403 angularly about the pivot assembly 1404, and the movable plunger 1405 can also be provided with detent means to register its position radially from the pivot assembly 1404 thus locating the plunger assembly over each hole 1406 in an indexed manner. The dispenser 1400 need only be provided with a storage hole 1406 arrangement that corresponds to the coordinate nature of the particular application.

Those skilled in the art will realize that this invention is capable of embodiments different from those shown and described. It will be appreciated that the detail of the structure of this apparatus and methodology can be changed in various ways without departing from the scope of this invention. Accordingly, the drawings and detailed description of the embodiments are to be regarded as including such equivalents as do not depart from the scope of the invention.

The invention claimed is:

1. A dispenser for loading pellets, each having a head and a skirt, into a pellet gun without a user having to touch the pellets, comprising:

an open ended tube having a proximal end and a distal end for holding the pellets in a line and in longitudinal orientation within the tube with the head of each longitudinally oriented pellet positioned toward the distal end of the tube and the skirt of each longitudinally oriented pellet positioned toward the proximal end of the tube;

a retention device at the open distal end of the tube for holding an end pellet in the tube, the retention device comprising at least one escapement tab extending through the side of the tube engaging the end pellet for retaining the pellet in place until it is pushed out of the dispenser;

a plunger located proximally at the end of the pellet line in communication with a last pellet in the pellet line for pushing the longitudinally oriented pellets toward the distal end of the tube to eject the end pellet at the distal end of the tube to the pellet gun, the plunger comprising a handle extending outside the tube and sliding longitudinally along the side of the tube for dispensing pellets, the plunger extending from the point of communication with the last pellet inside the tube to the handle;

a slot in the side of the tube for the plunger to follow as it is advanced toward the distal end of the tube as the plunger ejects each pellet; and a removable pellet seating device for advancing a dispensed pellet into a firing chamber of a break barrel design pellet gun, the seating device comprising a threaded pin, one end of the pin shaped to fit the skirt of a pellet, the pin disposed in a threaded hole in a cap attachable to the tube, the cap cut off at a right angle to the axis of the pin for aligning the end of the cap flush against the entrance to the firing chamber, and the pin adjustable in extension beyond the cut off end of the cap by turning the pin in the threaded hole, for locating the pellet at substantially the same position in the firing chamber each time the seating device advances a pellet into the firing chamber.

2. The dispenser of claim 1 wherein the pellet seating device can be removed from the dispenser for loading the dispenser.

3. The dispenser of claim 1 wherein the pellet seating device can be removed from the pellet dispenser and can be used without the rest of the dispenser for seating pellets in pellet guns.

4. The dispenser of claim 1 wherein the threaded elements of the pellet seating device are replaced with movable friction fit elements.

5. The dispenser of claim 1 wherein the plunger is replaced with a removable flexible coil pellet plunger comprising:

a coil of flexible material for pushing the pellets through the dispenser;

a carrier for storing the flexible material; and a thumb operated drive mechanism for advancing the flexible material down the length of the tube to push the pellets through the tube.

6. The dispenser of claim 1 further comprising indexing controls along the length of the tube for controlling the movement of the plunger as pellets are dispensed.

7. The dispenser of claim 1 wherein the dispenser is not reusable after once being emptied of pellets.

8. The dispenser of claim 1 wherein the distal end of the dispenser tube is bent to improve access and delivery of pellets to the breech of a bolt action design pellet gun.

9. The dispenser of claim 1 wherein a retention device comprising slots in the sides of the tube with a flexible retainer placed through the slots to allow passage of a pellet only when sufficient force to deform the flexible retainer is supplied replaces the escapement tabs.

10. The dispenser of claim 1 wherein a retention device comprising spring metal teeth to hold the pellets in the dispenser until sufficient force is supplied to deform the spring metal teeth allowing a pellet to pass replaces the escapement tabs.

11. The dispenser of claim 1 wherein the force of the escapement tab engagement with pellets in the retention device can be adjusted by changing the force applied from outside the tube on the escapement tabs as they engage a pellet in the retention device.

12. The dispenser of claim 1 wherein a retention device comprising flexible material disposed at the distal end of the tube replaces the escapement tabs.

13. A dispenser for loading pellets, each with a head, a waist, and a skirt, into a pellet gun without a user having to touch the pellets, comprising:

a tube having a proximal end and a distal end;

pellets in side-by-side orientation placed inside the tube for dispensing through the side of the tube;

a loading hole adjacent the proximal end of the tube for inserting the pellets in side-by-side orientation;

a retractable spring positioned in the proximal end of the tube for pushing the pellets toward the distal end of the tube;

a guide strip extending from adjacent the loading hole to adjacent the distal end of the tube, the guide strip for holding the pellets in orientation as they pass through the length of the tube, the guide strip engaging the waist of each pellet to maintain the pellet in desired orientation;

a distal hole perpendicular to the axis of the tube through opposite sides of the tube adjacent the distal end of the tube for dispensing pellets from the tube;

a spring loaded plunger accessible from the outside the tube and oriented to push through the distal hole to dispense pellets through the distal hole in the side of the tube, the plunger comprising a flat spring attached to the side of the tube and bent to position a plunger prong over the distal hole through which the plunger prong passes to dispense pellets from the tube, the spring returning the plunger prong after a pellet is dispensed, the plunger prong shaped to fit the skirt of a pellet;

a retaining device adjacent the outer wall of the tube to engage each pellet as it is passed through the side of the tube for holding the pellet in the tube until it is dispensed by the spring loaded plunger; and a cap for covering the loading hole to prevent loaded pellets from falling out of the tube.

14. The dispenser of claim 13 further comprising a removably attached pellet seating device for advancing a dispensed pellet into a firing chamber of a break barrel design pellet gun, the seating device comprising a threaded pin, one end of the pin shaped to fit the skirt of a pellet, the pin disposed in a threaded hole in the device, the device cut off at a right angle to the axis of the pin for aligning the end of the device flush against the entrance to the firing chamber, and the pin adjustable in extension beyond the cut off end of the device by turning the pin in the threaded hole for locating the pellet at substantially the same position in the firing chamber each time the seating device advances a pellet into the firing chamber.

15. A dispenser for dispensing individual pellet gun pellets into a firing chamber of a break barrel design pellet gun without a user's hand having to touch the pellets, comprising:

a storage device for storing the pellets individually in an orientation desired by a user and shaped to allow each pellet to be placed adjacent the firing chamber of the pellet gun;

a pellet removing device for removing an individual pellet from the storage device and delivering the pellet in the desired orientation to the firing chamber of the pellet gun; and a pellet seating device comprising a threaded pin having one end smaller in diameter than the diameter of the pellet gun bore, shaped to fit the skirt of a pellet and disposed in a threaded hole in the pellet seating device, the pellet seating device cut off at a right angle to the axis of the pin for aligning the pellet seating device flush against the entrance to the firing chamber, the pin adjustable in extension beyond the cut off end of the pellet seating device by turning the pin in the threaded hole, for locating each delivered pellet in substantially the same position in the firing chamber each time the seating device advances a pellet into the firing chamber.

16. The dispenser of claim 15 wherein the storage device is a rotatable disc comprising storage cells around its perimeter from which the pellet removing device can remove the pellets.

17. The dispenser of claim 15 wherein the storage device is a flexible strip of material comprising holes for gripping pellets until they are removed by the pellet removing device.

18. The dispenser of claim 15 wherein the pellet seating device can be removed from the dispenser and used to seat pellets without the presence of the other elements of the dispenser.

19. The dispenser of claim 15 wherein the pellet removing device is the pellet seating device.

20. The dispenser of claim 15 wherein the dispenser is used for dispensing individual pellet gun pellets into a firing chamber of a breech design pellet gun.

* * * * *